US006908894B2

(12) United States Patent
Kott et al.

(10) Patent No.: US 6,908,894 B2
(45) Date of Patent: Jun. 21, 2005

(54) ALKYLAROMATIC HYDROCARBON COMPOSITIONS

(75) Inventors: Kevin Lee Kott, Loveland, OH (US); Jeffrey John Scheibel, Loveland, OH (US); Thomas Anthony Cripe, Loveland, OH (US); Daniel Stedman Connor, Cincinnati, OH (US); Phillip Kyle Vinson, Fairfield, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/038,170

(22) Filed: Oct. 22, 2001

(65) Prior Publication Data

US 2002/0103096 A1 Aug. 1, 2002

Related U.S. Application Data

(62) Division of application No. 09/479,365, filed on Jan. 7, 2000, now Pat. No. 6,306,817, which is a continuation of application No. PCT/IB98/01103, filed on Jul. 20, 1998.

(60) Provisional application No. 60/053,321, filed on Jul. 21, 1997.

(51) Int. Cl.[7] ..... C11D 17/00

(52) U.S. Cl. ..... 510/424; 510/426; 510/428; 510/429; 585/513

(58) Field of Search ..... 585/513; 510/424, 510/426, 428, 429, 492

(56) References Cited

U.S. PATENT DOCUMENTS

| | | | | |
|---|---|---|---|---|
| 2,477,382 | A | | 7/1949 | Lewis |
| 2,564,072 | A | | 8/1951 | Lien et al. |
| 3,196,174 | A | | 7/1965 | Cohen |
| 3,238,249 | A | | 3/1966 | Mirviss et al. |
| 3,341,614 | A | | 9/1967 | Wirth et al. |
| 3,351,654 | A | * | 11/1967 | Gudelis ..... 585/7 |
| 3,355,484 | A | | 11/1967 | Bloch |
| 3,442,964 | A | | 5/1969 | Oldham |
| 3,442,965 | A | | 5/1969 | Oldham |
| 3,491,030 | A | | 1/1970 | Fields |
| 3,492,364 | A | | 1/1970 | Jones et al. |
| 3,562,797 | A | | 2/1971 | Hu |

(Continued)

FOREIGN PATENT DOCUMENTS

| | | |
|---|---|---|
| EP | 0 469 940 | 2/1992 |
| EP | 0 364 012 | 1/1993 |
| EP | 0 321 177 | 8/1994 |
| EP | 0 466 558 | 11/1997 |
| EP | 0 807 616 | 2/2001 |
| FR | 2697246 | 4/1994 |
| SU | 793972 | 1/1981 |
| WO | WO 97/01521 | 1/1997 |
| WO | WO 97/47573 | 12/1997 |
| WO | WO 99/05082 | 2/1999 |
| WO | WO 99/05241 | 2/1999 |
| WO | WO 99/05242 | 2/1999 |

OTHER PUBLICATIONS

George E. Hinds, "Petroleum–Based Raw Materials for Anionic Surfactants", Surfactant Science Series, 1996, pp. 11–86, vol. 1, Marcel Dekker, Inc. New York.

Nooi, J. R. et al., "Isomerization Reactions Occuring on Alkylation of Benzene with Some Branched Long–Chain 1–Alkenes", 1969, pp. 398–410, vol. 88, No. 4, Recueil.

"Hydrocarbon Mixture", Research Disclosure No. 41412, Oct. 1998, vol. 414.

*Primary Examiner*—Necholus Ogden
(74) *Attorney, Agent, or Firm*—Laura R. Grunzinger; Kim William Zerby; Steven W. Miller

(57) ABSTRACT

A surfactant composition comprising:

alkylarylsulfonate surfactant system comprising at least two isomers of the alkylarylsulfonate surfactant of the formula:

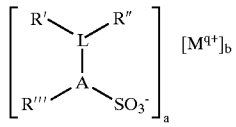

wherein:

L is an acyclic aliphatic hydrocarbyl of from 6 to 18 carbon atoms in total;

M is a cation or cation mixture and q is the valence thereof;

a and b are numbers selected such that said composition is electroneutral;

R' is selected from H and $C_1$ to $C_3$ alkyl;

R" is selected from H and $C_1$ to $C_3$ alkyl;

R'" is selected from H and $C_1$ to $C_3$ alkyl;

any of R' and R" is nonterminally attached to L and at least one of R' and R" is $C_1$ to $C_3$ alkyl; and A is aryl; and wherein:

said alkylarylsulfonate surfactant system comprises two or more isomers with respect to positions of attachment of R', R" and A to L;

in at least about 60% of said composition, A is attached to L in the position which is selected from positions alpha- and beta- to either of the two terminal carbon atoms thereof; and wherein further said alkylarylsulfonate surfactant system has at least one (preferably both) of the following properties:

said alkylarylsulfonate surfactant system has a ratio of nonquaternary to quaternary carbon atoms in L of at least about 10:1 by weight, when said quaternary carbon atoms are present; and there is no more than 40% by weight loss as measured by Hardness Tolerance Test.

25 Claims, No Drawings

U.S. PATENT DOCUMENTS 3,674,885 A 7/1972 Griesinger et al.
4,235,810 A 11/1980 Osselet et al.
4,301,316 A 11/1981 Young
4,301,317 A 11/1981 Young
4,447,664 A 5/1984 Murchison et al.
4,533,651 A 8/1985 Masters et al.
4,587,374 A 5/1986 Peters
4,731,497 A 3/1988 Grey
4,855,527 A 8/1989 Page et al.
4,870,038 A * 9/1989 Page et al. ..... 502/62
4,959,491 A 9/1990 Threlkel
4,962,256 A 10/1990 Le et al.
4,973,788 A 11/1990 Lin et al.
4,990,718 A 2/1991 Pelrine
4,996,386 A 2/1991 Hamilton et al.
5,026,933 A * 6/1991 Blain et al. ..... 585/7
5,030,785 A 7/1991 Huss et al.
5,087,788 A 2/1992 Wu
5,146,026 A 9/1992 Berna Tejero et al.
5,177,280 A 1/1993 Juguin et al.
5,196,574 A 3/1993 Kocal
5,196,624 A 3/1993 Threlkel et al.
5,196,625 A 3/1993 Threlkel et al.
5,198,595 A 3/1993 Lee et al.
5,246,566 A 9/1993 Miller
5,258,566 A 11/1993 Kresge et al.
5,302,732 A 4/1994 Steigleder et al.
5,401,896 A 3/1995 Kuehl et al.
5,491,271 A 2/1996 Marinangeli et al.
5,510,306 A 4/1996 Murray
5,602,292 A 2/1997 Perego et al.
5,625,105 A 4/1997 Lin et al.
5,648,585 A 7/1997 Murray et al.
5,770,782 A 6/1998 Knifton et al.
5,811,612 A 9/1998 Girotti et al.
5,811,623 A 9/1998 Ryu et al.
5,847,254 A 12/1998 Knifton et al.
5,866,748 A 2/1999 Wittenbrink et al.
6,274,540 B1 8/2001 Scheibel et al.

* cited by examiner

ALKYLAROMATIC HYDROCARBON COMPOSITIONS

CROSS REFERENCE

This is a divisional under 35 USC §120 of U.S. application Ser. No. 09/479,365 filed Jan. 7, 2000 now U.S. Pat. No. 6,306,817, which is a continuation of PCT International Application Serial No. PCT/IB98/01103, filed Jul. 20, 1998; which claims priority to Provisional Application Ser. No. 60/053,321, filed Jul. 21, 1997.

FIELD OF THE INVENTION

The present invention relates to improved detergent and cleaning products containing particular types of alkylarylsulfonate surfactants. More particularly, these alkylarylsulfonates have chemical compositions which differ both from the highly branched nonbiodegradable or "hard" alkylbenzenesulfonates still commercially available in certain countries; and which differ also from the so-called linear alkylbenzenesulfonates which have replaced them in most geographies, including the most recently introduced so-called "high 2-phenyl" types. Moreover the selected surfactants are formulated into new detergent compositions by combination with particular detergent adjuncts. The compositions are useful for cleaning a wide variety of substrates.

BACKGROUND OF THE INVENTION

Historically, highly branched alkylbenzenesulfonate surfactants, such as those based on tetrapropylene (known as "ABS") were used in detergents. However, these were found to be very poorly biodegradable. A long period followed of improving manufacturing processes for alkylbenzenesulfonates, making them as linear as practically possible ("LAS"). The overwhelming part of a large art of linear alkylbenzenesulfonate surfactant manufacture is directed to this objective. All relevant large-scale commercial alkylbenzenesulfonate processes in use today are directed to linear alkylbenzenesulfonates. However, linear alkylbenzenesulfonates are not without limitations; for example, they would be more desirable if improved for hard water and/or cold water cleaning properties. Thus, they can often fail to produce good cleaning results, for example when formulated with nonphosphate builders and/or when used in hard water areas.

As a result of the limitations of the alkylbenzenesulfonates, consumer cleaning formulations have often needed to include a higher level of cosurfactants, builders, and other additives than would have been needed given a superior alkylbenzenesulfonate.

Accordingly it would be very desirable to simplify detergent formulations and deliver both better performance and better value to the consumer. Moreover, in view of the very large tonnages of alkylbenzenesulfonate surfactants and detergent formulations used worldwide, even modest improvements in performance of the basic alkylbenzenesulfonate detergent could carry great weight.

To understand the art of making and use of sulfonated alkylaromatic detergents, one should appreciate that it has gone through many stages and includes (a) the early manufacture of highly branched nonbiodegradable LAS (ABS); (b) the development of processes such as HF or $AlCl_3$ catalyzed process (note each process gives a different composition, e.g., HF/olefin giving lower 2-phenyl or classic $AlCl_3$/chloroparaffin typically giving byproducts which though perhaps useful for solubility are undesirable for biodegradation); (c) the market switch to LAS in which a very high proportion of the alkyl is linear; (d) improvements, including so-called 'high 2-phenyl' or DETAL processes (in fact not really "high" 2-phenyl owing to problems of solubility when the hydrophobe is too linear); and (e) recent improvements in the understanding of biodegradation.

The art of alkylbenzenesulfonate detergents is extraordinarily replete with references which teach both for and against almost every aspect of these compositions. For example, some of the art teaches toward high 2-phenyl LAS as desirable, while other art teaches in exactly the opposite direction. There are, moreover, many erroneous teachings and technical misconceptions about the mechanism of LAS operation under in-use conditions, particularly in the area of hardness tolerance. The large volume of such references debases the art as a whole and makes it difficult to select the useful teachings from the useless without large amounts of repeated experimentation. To further understand the state of the art, it should be appreciated that there has been not only a lack of clarity on which way to go to fix the unresolved problems of linear LAS, but also a range of misconceptions, not only in the understanding of biodegradation but also in basic mechanisms of operation of LAS in presence of hardness. According to the literature, and general practice, surfactants having alkali or alkaline earth salts that are relatively insoluble (their Na or Ca salts have relatively high Krafft temperature) are less desirable than those having alkali or alkaline earth salts which are relatively higher in solubility (Na or Ca salts have lower Krafft temperature). In the literature, LAS mixtures in the presence of free Ca or Mg hardness are said to precipitate. It is also known that the 2-or 3-phenyl or "terminal" isomers of LAS have higher Krafft temperatures than, say, 5-or 6-phenyl "internal" isomers. Therefore, it would be expected that changing an LAS composition to increase the 2-and 3-phenyl isomer content would decrease the hardness tolerance and solubility: not a good thing. On the other hand it is also known that with built conditions under which both the 2-and 3-phenyl and internal-phenyl isomers at equal chain length can be soluble, the 2-and 3-phenyl isomers are more surface-active materials. Therefore, it would be expected that changing an LAS composition to increase the 2-and 3-phenyl isomer content may increase the cleaning performance. However, the unsolved problems with solubility, hardness tolerance, and low temperature performance still remain.

BACKGROUND ART

U.S. Pat. No. 5,026,933; U.S. Pat. No. 4,990,718; U.S. Pat. No. 4,301,316; U.S. Pat. No. 4,301,317; U.S. Pat. No. 4,855,527; U.S. Pat. No. 4,870,038; U.S. Pat. No. 2,477,382; EP 466,558, Jan. 15, 1992; EP 469,940, Feb. 5, 1992; FR 2,697,246, Apr. 29, 1994; SU 793,972, Jan. 7, 1981; U.S. Pat. No. 2,564,072; U.S. Pat. No. 3,196,174; U.S. Pat. No. 3,238,249; U.S. Pat. No. 3,355,484; U.S. Pat. No. 3,442,964; U.S. Pat. No. 3,492,364; U.S. Pat. No. 4,959,491; WO 88/07030, Sep. 25, 1990; U.S. Pat. No. 4,962,256, U.S. Pat. No. 5,196,624; U.S. Pat. No. 5,196,625; EP 364,012 B, Feb. 15, 1990; U.S. Pat. No. 3,312,745; U.S. Pat. No. 3,341,614; U.S. Pat. No. 3,442,965; U.S. Pat. No. 3,674,885; U.S. Pat. No. 4,447,664; U.S. Pat. No. 4,533,651; U.S. Pat. No. 4,587,374; U.S. Pat. No. 4,996,386; U.S. Pat. No. 5,210,060; U.S. Pat. No. 5,510,306; WO 95/17961, Jul. 6, 1995; WO 95/18084; U.S. Pat. Nos. 5,087,788; 5,625,105 and 4,973,788 are useful by way of background to the invention. The manufacture of alkylbenzenesulfonate surfactants has recently been reviewed. See Vol 56 in "Surfactant Science"

series, Marcel Dekker, New York, 1996, including in particular Chapter 2 entitled "Alkylarylsulfonates: History, Manufacture, Analysis and Environmental Properties", pages 39–108 which includes 297 literature references. Documents referenced herein are incorporated in their entirety.

SUMMARY OF THE INVENTION

It is an aspect herein to provide improved detergent compositions comprising certain sulfonated alkylbenzenes. It is another aspect to provide the improved surfactants and surfactant mixtures comprising the same. These and other aspects of the present invention will be apparent from the description hereinafter.

The present invention has numerous advantages beyond satisfying one or more of the aspects identified hereinabove, including but not limited to: superior cold-water solubility, for example for cold water laundering; superior hardness tolerance; and excellent detergency, especially under low-temperature wash conditions. Further, the invention is expected to provide reduced build-up of old fabric softener residues from fabrics being laundered, and improved removal of lipid or greasy soils from fabrics. Benefits are expected also in non-laundry cleaning applications, such as dish cleaning. The development offers substantial expected improvements in ease of manufacture of relatively high 2-phenyl sulfonate compositions, improvements also in the ease of making and quality of the resulting detergent formulations; and attractive economic advantages.

The present invention is based on an unexpected discovery that there exist, in the middle ground between the old, highly branched, nonbiodegradable alkylbenzenesulfonates and the new linear types, certain alkylbenzenesulfonates which are both more highly performing than the latter and more biodegradable than the former.

The new alkylbenzenesulfonates are readily accessible by several of the hundreds of known alkylbenzenesulfonate manufacturing processes. For example, the use of certain dealuminized mordenites permits their convenient manufacture.

In accordance with a first aspect of present the invention a novel surfactant system is provided. This novel surfactant system comprises at least two isomers of the alkylarylsulfonate surfactant of the formula:

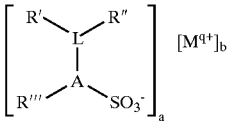

(I)

wherein:

L is an acyclic aliphatic hydrocarbyl of from 6 to 18 carbon atoms in total;

M is a cation or cation mixture and q is the valence thereof;

a and b are numbers selected such that said alkylarylsulfonate surfactant is electroneutral;

R' is selected from H and $C_1$ to $C_3$ alkyl;

R" is selected from H and $C_1$ to $C_3$ alkyl;

R'" is selected from H and $C_1$ to $C_3$ alkyl;

both of R' and R" are nonterminally attached to L and at least one of R' and

R" is $C_1$ to $C_3$ alkyl; and

A is aryl; and wherein:

said alkylarylsulfonate surfactant system comprises two or more isomers with respect to positions of attachment of R', R" and A to L;

in at least about 60% of said composition, A is attached to L in the position which is selected from positions alpha- and beta- to either of the two terminal carbon atoms of L; and wherein further said alkylarylsulfonate surfactant system has at least one (preferably both) of the following properties:

said alkylarylsulfonate surfactant system has a ratio of nonquaternary to quaternary carbon atoms in L of at least about 10:1 (preferably at least about 20:1; more preferably at least about 100:1) by weight, when said quaternary carbon atoms are present; and there is no more than 40% by weight loss as measured by Hardness Tolerance Test.

In accordance with a second aspect of the present invention a novel surfactant composition is provided. This novel surfactant composition comprises:

at least two isomers, counted exclusive of ortho-, meta-, para- ,and stereoisomers of an alkylarylsulfonate surfactant of the formula:

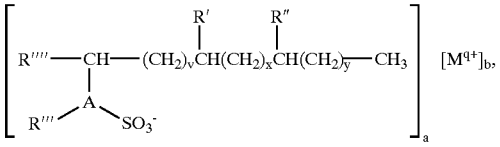

wherein M is a cation, q is the valence of said cation, a and b are numbers selected such that said composition is electroneutral; A is aryl; R'" is selected from H and $C_1$ to $C_3$ alkyl; R' is selected from hydrogen and $C_1$ to $C_3$ alkyl; R" is selected from hydrogen and $C_1$ to $C_3$ alkyl; and R"" is selected from hydrogen and $C_1$ to $C_4$ alkyl; v is an integer from 0 to 10; x is an integer from 0 to 10; y is an integer from 0 to 10;

wherein:

the total number of carbon atoms attached to A is less than about 20 (preferably from about 9 to about 18; more preferably from about 10 to about 14);

said alkylarylsulfonate surfactant system comprises two or more isomers with respect to positions of attachment of R', R" and A to the moiety R""—C(—)H$(CH_2)_v$C(—)H$(CH_2)_x$C(—)H$(CH_2)_y$—$CH_3$ of this formula;

at least one of R' and R" is $C_1$ to $C_3$ alkyl; when R"" is $C_1$, the sum of v+x+y is at least 1; and when R"" is H, the sum of v+x+y is at least 2; and in at least about 60% of said composition, A is attached to the moiety R""—C(—)H$(CH_2)_v$C(—)H$(CH_2)_x$C(—)H$(CH_2)_y$—$CH_3$ in the position which is selected from positions alpha- and beta- to either of the two terminal carbon atoms thereof;

wherein further said alkylarylsulfonate surfactant system has at least one (preferably both) of the following properties:

said alkylarylsulfonate surfactant system has a ratio of nonquaternary to quaternary carbon atoms in the moiety R""—C(—)H$(CH_2)_v$C(—)H$(CH_2)_x$C(—)H$(CH_2)_y$—$CH_3$ of at least about 10:1 by weight, when said quaternary carbon atoms are present; and there is no more than 40% by weight loss as measured by Hardness Tolerance Test.

In accordance with a third aspect of the present invention a novel surfactant composition is provided. This novel surfactant composition comprises:

a) from about 0.01% to about 99.99% by weight of an alkylarylsulfonate surfactant system comprising at least two isomers of the alkylarylsulfonate surfactant of the formula:

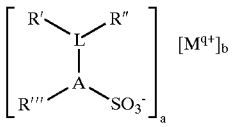

wherein:

L is an acyclic aliphatic hydrocarbyl of from 6 to 18 carbon atoms in total;

M is a cation or cation mixture and q is the valence thereof;

a and b are numbers selected such that said composition is electroneutral;

R' is selected from H and $C_1$ to $C_3$ alkyl;

R" is selected from H and $C_1$ to $C_3$ alkyl;

R'" is selected from H and $C_1$ to $C_3$ alkyl;

both of R' and R" are nonterminally attached to said L and at least one of R' and R" is $C_1$ to $C_3$ alkyl; and A is aryl; and wherein:

said alkylarylsulfonate surfactant system comprises two or more isomers with respect to positions of attachment of R', R" and A to L;

in at least about 60% of said composition, A is attached to L in the position which is selected from positions alpha- and beta- to either of the two terminal carbon atoms thereof; and wherein further said alkylarylsulfonate surfactant system has at least one (preferably both) of the following properties:

said alkylarylsulfonate surfactant system has a ratio of nonquaternary to quaternary carbon atoms in L of at least about 10:1 by weight, when said quaternary carbon atoms are present; and there is no more than 40% by weight loss as measured by Hardness Tolerance Test; and b) from about 0.01% to about 99.99% by weight of at least one isomer of the linear analogue of said alkylarylsulfonate surfactant (a).

In accordance with a fourth aspect of the present invention a novel surfactant composition is provided. This novel surfactant composition comprises:

a) from about 0.01% to about 99.99% by weight of an alkylarylsulfonate surfactant system comprising at least two isomers, counted exclusive of ortho-, meta-, para- and stereoisomers, of an alkylarylsulfonate surfactant of the formula:

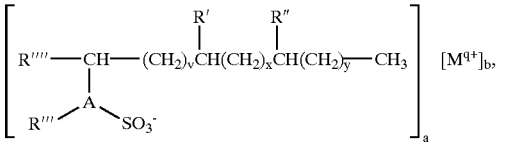

wherein M is a cation, q is the valence of said cation, a and b are numbers selected such that said composition is electroneutral; A is aryl; R'" is selected from H and $C_1$ to $C_3$ alkyl; R' is selected from hydrogen and $C_1$ to $C_3$ alkyl; R'" is selected from hydrogen and $C_1$ to $C_3$ alkyl; and R'" is selected from hydrogen and $C_1$ to $C_4$ alkyl; v is an integer from 0 to 10; x is an integer from 0 to 10; y is an integer from 0 to 10;

wherein:

the total number of carbon atoms attached to A is less than about 20;

said alkylarylsulfonate surfactant system comprises two or more isomers with respect to positions of attachment of R', R" and A to the moiety R'"—C(—)H$(CH_2)_v$C(—)H$(CH_2)_x$C(—)H$(CH_2)_y$—$CH_3$ of this formula;

at least one of R' and R" is $C_1$ to $C_3$ alkyl; when R"" is $C_1$, the sum of v+x+y is at least 1; and when R"" is H, the sum of v+x+y is at least 2; and in at least about 60% of said composition, A is attached to the moiety R""—C(—)H$(CH_2)_v$C(—)H$(CH_2)_x$C(—)H$(CH_2)_y$—$CH_3$ in the position which is selected from positions alpha- and beta- to either of the two terminal carbon atoms thereof;

wherein further said alkylarylsulfonate surfactant system has at least one (preferably both) of the following properties:

said alkylarylsulfonate surfactant system has a ratio of nonquaternary to quaternary carbon atoms in the moiety R""—C(—)H$(CH_2)_v$C(—) H$(CH_2)_x$C(—)H$(CH_2)_y$—$CH_3$ of at least about 10:1 by weight, when said quaternary carbon atoms are present; and there is no more than 40% by weight loss as measured by Hardness Tolerance Test; and b) from about 0.01% to about 99.99% by weight of at least one isomer of the linear analogue of said alkylarylsulfonate surfactant (a).

In all of these four aspects of the invention, the surfactant system will preferably comprise at least two, preferably at least four, more preferably at least eight, even more preferably at least twelve, even more preferably still at least sixteen and most preferably at least twenty, isomers and/or homologs of alkyarylsulfonate surfactant of formula (I). "Isomers", which are described herein after in more detail, include especially those compounds having different positions of attachment of the moieties R' and/or R" to the L moiety. "Homologs" vary in the number of carbon atoms contained in the sum of L, R' and R".

In accordance with a fifth aspect of present the invention, a novel cleaning composition is provided. This novel cleaning composition comprises from about 0.01% to about 99.99% by weight of one of the novel surfactant compositions and from about 0.0001% to about 99.99% by weight of a cleaning additive, described in detail herein after.

The cleaning composition will preferably contain at least about 0.1%, more preferably at least about 0.5%, even more preferably still, at least about 1% by weight of said composition of the surfactant system. The cleaning composition will also preferably contain no more than about 80%, more preferably no more than about 60%, even more preferably, still no more than about 40% by weight of said composition of the surfactant system.

Accordingly, it is an aspect of the present invention to provide novel cleaning compositions. These, and other, aspects, features and advantages will be clear from the following detailed description and the appended claims.

All percentages, ratios and proportions herein are by weight, unless otherwise specified. All temperatures are in degrees Celsius (° C.) unless otherwise specified. All documents cited are in relevant part, incorporated herein by reference.

DETAILED DESCRIPTION OF THE INVENTION

The present invention relates to novel surfactant compositions. It also relates to novel cleaning compositions containing the novel surfactant system.

The surfactant system comprises at least two isomers of the alkylarylsulfonate surfactant of the formula:

(I)

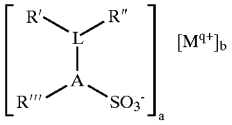

wherein M is a cation or cation mixture. Preferably, M is an alkali metal, an alkaline earth metal, ammonium, substituted ammonium or mixtures thereof, more preferably sodium, potassium, magnesium, calcium or mixtures thereof. The valence of said cation, q, is preferably 1 or 2. The numbers a and b are selected such that said composition is electroneutral; a and b are preferably 1 or 2, and 1, respectively.

A is selected from aryl. Preferably, Ar is benzene, toluene, xylene, naphthalene, and mixtures thereof, more preferably Ar is benzene or toluene, most preferably benzene.

R' is selected from H and $C_1$ to $C_3$ alkyl. Preferably, R' is H or $C_1$ to $C_2$ alkyl, more preferably, R' is methyl or ethyl, most preferably R' is methyl. R" is selected from H and $C_1$ to $C_3$ alkyl. Preferably, R'" is H or $C_1$ to $C_2$ alkyl, more preferably, R'" is H or methyl. R'" is selected from H and $C_1$ to $C_3$ alkyl. Preferably R'" is H or $C_1$ to $C_2$ alkyl, more preferably, R'" is H or methyl, most preferably R'" is H. Both of R' and R" are nonterminally attached to L. That is, R,' and R" do not add to the overall chain length of L, but rather, are groups branching from L. Also, at least one of R' and R" is $C_1$ to $C_3$ alkyl. This limits L to a hydrocarbyl molecule with at least one alkyl branch.

L is an acyclic aliphatic hydrocarbyl of from 6 to 18, preferably from 9 to 14 (when only one methyl branching), carbon atoms in total. The preferred L is a moiety R""—C(—)H$(CH_2)_v$C(—)H$(CH_2)_x$C(—)H$(CH_2)_y$—$CH_3$, which includes the R"", but not R', R"or the A moiety, in the formula (II) below (II)

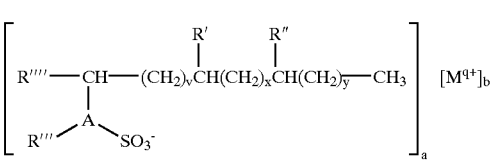

wherein R', R", R'", A, M, q, a and b are hereinbefore defined. R"" is selected from H and $C_1$ to $C_4$ alkyl. Preferably, R"" is hydrogen and $C_1$ to $C_3$, more preferably R"" is hydrogen and $C_1$ to $C_2$ and most preferably R"" is methyl or ethyl. The numbers of the methylene subunits, v, x and y are each independently integers from 0 to 10 provided that the total number of carbons attached to A is less than about 20. This number is inclusive of R', R", R'" and R"". Furthermore, when R"" is $C_1$, the sum of v+x+y is at least 1; and when R"" is H, the sum of v +x+y is at least 2. In the moiety R""—C(—)H$(CH_2)_v$C(—)H$(CH_2)_x$C(—)H$(CH_2)_y$—$CH_3$ the three C(—) indicate the three carbon atoms where A, R' and R" are attached to the moiety.

The alkylarylsulfonate surfactant system comprises two or more isomers with respect to positions of attachment of R', R" and A to L. In at least about 60%, about preferably, 80%, more preferably, 100%, of the surfactant composition, A is attached to L in the position which is selected from positions alpha- and beta- to either of the two terminal carbon atoms of L. The terms alpha- and beta- mean the carbon atoms which are one and two carbon atoms away, respectively, from the terminal carbon atoms. To better explain this, the structure below shows the two possible alpha-positions and the two possible beta-positions in a general linear hydrocarbon.

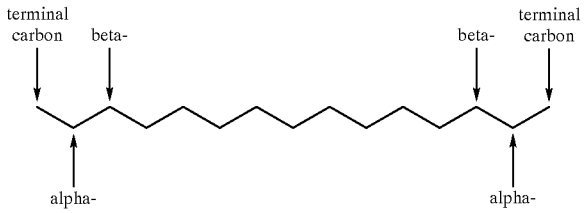

Furthermore, in the first aspect of the invention, the alkylarylsulfonate surfactant system has a ratio of nonquaternary to quaternary carbon atoms in L of at least about 10:1 by weight when said quaternary carbon atoms are present. Preferably the weight ratio of nonquaternary to quaternary in L is at least about 20:1, most preferably about 100:1.

Furthermore, there is no more than 40%, preferably 20% more preferably 10% by weight loss as measured by Hardness Tolerance Test, as described herein after.

In another aspect of the invention, the second embodiment of the surfactant composition can contain a surfactant system comprising at least one isomer of the linear analog of said alkylarylsulfonate surfactant. By linear analogue, it is meant that the structure of the alkylaryl sulfonate surfactant would be:

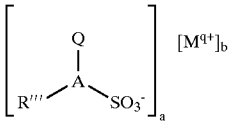

wherein A, R'", M, q, a and b are as herein before defined, and Q is a linear hydrocarbyl containing from 5 to 20 carbon atoms. Preferably the total carbon atoms in Q equals the total of the carbon atoms in the sum of R', L, and R" of the surfactant of Formula (I) herein above.

In the second aspect of the invention, the surfactant composition comprises an alkylarylsulfonate surfactant system comprising at least two isomers, counted exclusive of ortho-, meta-, para-,and stereoisomers of an alkylarylsulfonate surfactant of the formula:

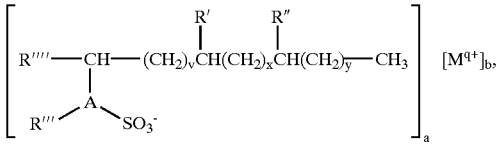

wherein A, R', R", R'", R"", M, q, a, b, v, x, and y are as herein before defined.

The alkylarylsulfonate surfactant system comprises two or more isomers with respect to positions of attachment of R', R" and A to the L moiety R""—C(—)H($CH_2$)$_v$C(—)H($CH_2$)$_x$C(—)H($CH_2$)$_y$—$CH_3$. In at least about 60%, preferably, about 80%, more preferably, about 100% of the surfactant composition A is attached to the L moiety R""—C(—)H($CH_2$)$_v$C(—)H($CH_2$)$_x$C(—)H($CH_2$)$_y$—$CH_3$in the position which is selected from positions alpha- and beta- to either of the two terminal carbon atoms of R""—C(—)H($CH_2$)$_v$C(—)H($CH_2$)$_x$C(—)H($CH_2$)$_y$—$CH_3$.

Furthermore in the first aspect of the invention the alkylarylsulfonate surfactant system has a ratio of nonquaternary to quaternary carbon atoms in the L moiety R""—C(—)H($CH_2$)$_v$C(—)H($CH_2$)$_x$C(—)H($CH_2$)$_y$—$CH_3$of at least about 10:1 by weight when said quaternary carbon atoms are present. Preferably the weight ratio of nonquaternary to quaternary carbon atoms in R""—C(—)H($CH_2$)$_v$C(—)H($CH_2$)$_x$C(—)H($CH_2$)$_y$—$CH_3$ is at least about 20:1, most preferably about 100:1.

Furthermore, it is provided that there is less than 40%, preferably less than 20% more preferably less than 10% by weight loss as measured by Hardness Tolerance Test.

In another aspect of the invention the second embodiment of the surfactant composition can contain a surfactant system comprising at least one isomer of the linear analog of said alkylarylsulfonate surfactant. By linear analogue, it is meant that the structure of the alkylaryl sulfonate surfactant would be:

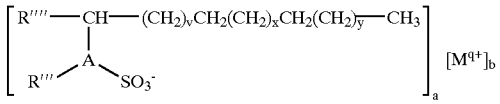

wherein A, R'", R"", M, q, a and b are herein before defined, provided that R"" is n-alkyl. In other words R' and R" are both hydrogen. This linear analogue would not have all the properties of the alkylarylsulfonate surfactant system. That is, there can be less than about 60% of the analogue in which A is attached to the moiety R""—C(—)H($CH_2$)$_v$$CH_2$($CH_2$)$_x$$CH_2$($CH_2$)$_y$—$CH_3$ in the position which is selected from positions alpha- and beta- to either of the two terminal carbon atoms thereof. Likewise, there can be more than 40% weight loss for the analogue when tested as a surfactant system in the Hardness Tolerance Test.

Alkylarylsulfonate Surfactant System

The present invention is directed to an alkylarylsulfonate surfactant system containing at least two isomers of the formula:

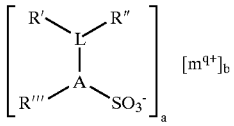

wherein L, M, R', R", R'", q, a, b, A, are as hereinbefore defined.

The present invention is also directed to an alkylarylsulfonate surfactant system containing at least two isomers of the formula:

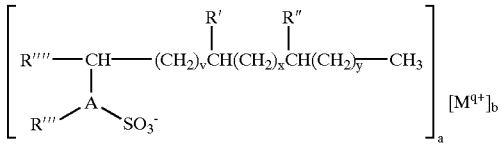

wherein R"", M, R', R", R'", q, a, b, A, v, x and y are hereinbefore defined. Possible isomers present in both of the alkylaryl sulfonate system are:

(a)

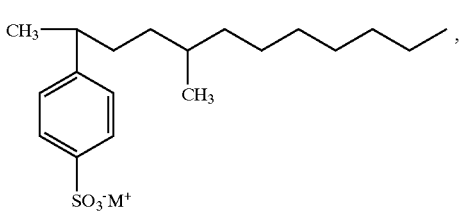

(b)

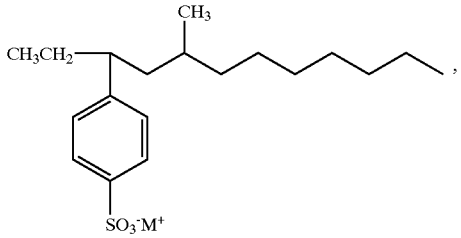

(c)

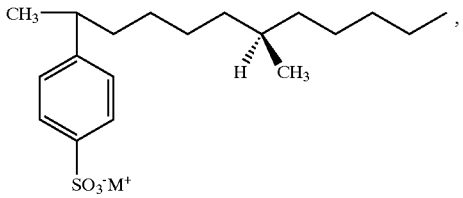

(d)

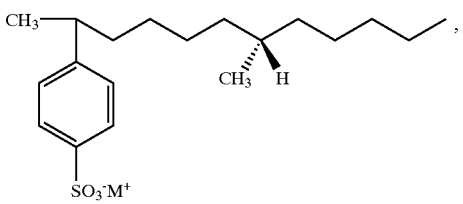

-continued (e)

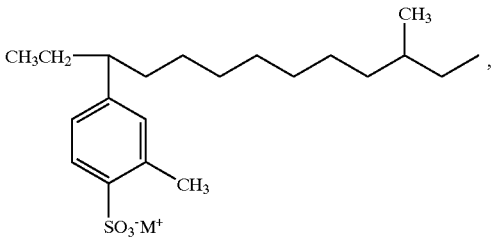

(f)

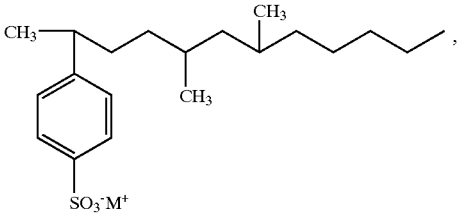

(g)

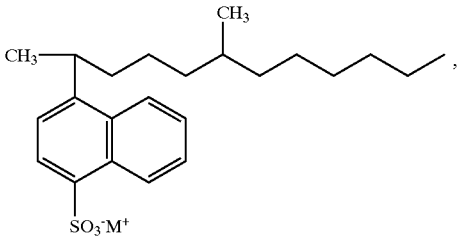

(h)

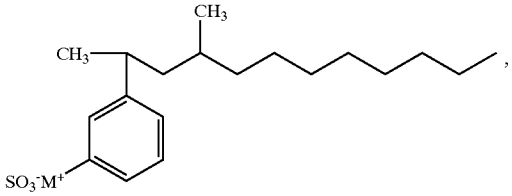

(i)

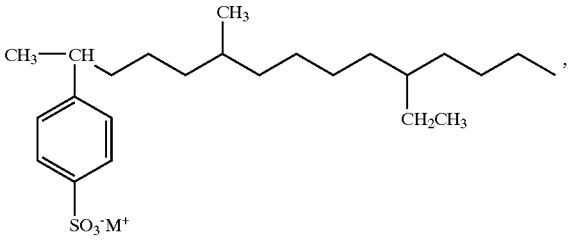

(j)

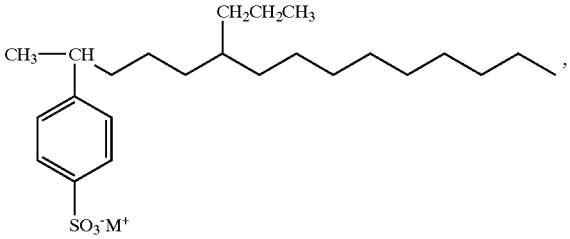

-continued (k)

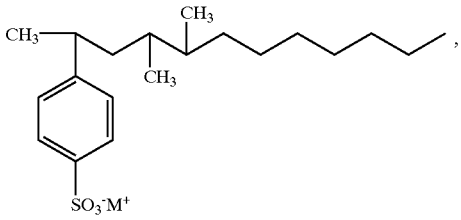

(l)

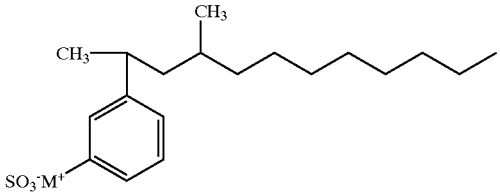

and (m)

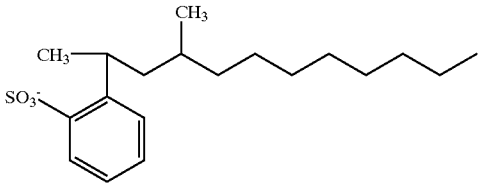

Structures (a) to (m) are only illustrative of some possible alkylarylsulfonate surfactants and are not intended to be limiting in the scope of the invention.

It is also preferred that the alkylarylsulfonate surfactants include at least two "isomers" selected from:

i) positional isomers based on positions of attachment of substituents R' and R" to L;

ii) stereoisomers based on chiral carbon atoms in L or its substituents;

iii) ortho-, meta- and para- isomers based on positions of attachment of substituents to Ar, when Ar is a substituted or unsubstituted benzene. This means that L can be ortho-, meta- or para- to A, L can be ortho-, meta- and para- to a substituent on A other than L (for example R'"), or any other possible alternative.

An example of two type (i) isomers are structures are (a) and (c). The difference is that the methyl in (a) is attached at the 5-position, but in (c) the methyl is attached at the 7-position.

An example of two type (ii) isomers are structures are (c) and (d). The difference is that these isomers are stereoisomers, the chiral carbon being the 7th carbon atom in the hydrocarbyl moiety.

An example of two type (iii) isomers are structures are (l) and (m). The difference is that the sulfonate group in (l) is meta- to the hydrocarbyl moiety, but in (m) the sulfonate is ortho- to the hydrocarbyl moiety.

EXAMPLE 1

Improved Alkylbenzenesulfonate Surfactant System Prepared via Skeletally Isomerized Linear Olefin Step (a): at Least Partially Reducing the Linearity of an Olefin (by Skeletal Isomerization of Olefin Preformed to Chainlengths Suitable for Cleaning Product Detergency)

A mixture of 1-decene, 1-undecene, 1-dodecene and 1-tridecene (for example available from Chevron) at a weight ratio of 1:2:2:1 is passed over a Pt-SAPO catalyst at 2200° C. and any suitable LHSV, for example 1.0. The catalyst is prepared in the manner of Example 1 of U.S. Pat. No. 5,082,956. See WO 95/21225, e.g., Example 1 and the specification thereof. The product is a skeletally isomerized lightly branched olefin having a range of chainlengths suitable for making an alkylbenezenesulfonate surfactant system for consumer cleaning composition incorporation. More generally the temperature in this step can be from about 200° C. to about 400° C., preferably from about 230° C. to about 320° C. The pressure is typically from about 15 psig to about 2000 psig, preferably from about 15 psig to about 1000 psig, more preferably from about 15 psig to about 600 psig. Hydrogen is a useful pressurizing gas. The space velocity (LHSV or WHSV) is suitably from about 0.05 to about 20. Low pressure and low hourly space velocity provide improved selectivity, more isomerization and less cracking. Distill to remove any volatiles boiling at up to 40° C./10 mmHg.

Step (b): Alkylating the Product of Step (a) Using an Aromatic Hydrocarbon

To a glass autoclave liner is added 1 mole equivalent of the lightly branched olefin mixture produced in step (a), 20 mole equivalents of benzene and 20 wt. % based on the olefin mixture of a shape selective zeolite catalyst (acidic mordenite catalyst Zeocat™ FM-8/25H). The glass liner is sealed inside a stainless steel rocking autoclave. The autoclave is purged twice with 250 psig $N_2$, and then charged to 1000 psig $N_2$. With mixing, the mixture is heated to 170–190° C. for 14–15 hours at which time it is then cooled and removed from the autoclave. The reaction mixture is filtered to remove catalyst and is concentrated by distilling off unreacted starting-materials and/or impurities (e.g., benzene, olefin, paraffin, trace materials, with useful materials being recycled if desired) to obtain a clear near-colorless liquid product. The product formed is a desirable improved alkylbenzene which can, as an option, be shipped to a remote manufacturing facility where the additional steps of sulfonation and incorporation into consumer cleaning compositions can be accomplished.

Step (c): Sulfonating the Product of Step (b)

The product of step (b) is sulfonated with an equivalent of chlorosulfonic acid using methylene chloride as solvent. The methylene chloride is distilled away.

Step (d): Neutralizing the Product of Step (c )

The product of step (c ) is neutralized with sodium methoxide in methanol and the methanol evaporated to give an improved alkylbenzenesulfonate surfactant system.

EXAMPLE 2

Improved Alkylbenzenesulfonate Surfactant System Prepared via Skeletally Isomerized Linear Olefin The procedure of Example 1 is repeated with the exception that the sulfonating step, (c), uses sulfur trioxide (without methylene chloride solvent) as sulfonating agent. Details of sulfonation using a suitable air/sulfur trioxide mixture are provided in U.S. Pat. No. 3,427,342, Chemithon. Moreover, step (d) uses sodium hydroxide in place of sodium methoxide for neutralization.

EXAMPLE 3

Improved Alkylbenzenesulfonate Surfactant System Prepared via Skeletally Isomerized Linear Olefin Step (a): at Least Partially Reducing the Linearity of an Olefin A lightly branched olefin mixture is prepared by passing a mixture of C11, C12 and C13 mono olefins in the weight ratio of 1:3:1 over H-ferrierite catalyst at 430° C. The method and catalyst of U.S. Pat. No. 5,510,306 can be used for this step. Distill to remove any volatiles boiling at up to 40° C./10 mmHg.

Step (b): Alkylating the Product of Step (a) Using an Aromatic Hydrocarbon

To a glass autoclave liner is added 1 mole equivalent of the lightly branched olefin mixture of step (a), 20 mole equivalents of benzene and 20 wt. % ,based on the olefin mixture, of a shape selective zeolite catalyst (acidic mordenite catalyst Zeocat™ FM-8/25H). The glass liner is sealed inside a stainless steel, rocking autoclave. The autoclave is purged twice with 250 psig $N_2$, and then charged to 1000 psig $N_2$. With mixing, the mixture is heated to 170–190° C. overnight for 14–15 hours at which time it is then cooled and removed from the autoclave. The reaction mixture is filtered to remove catalyst. Benzene is distilled and recycled, volatile impurities also being removed. A clear colorless or nearly colorless liquid product is obtained.

Step (c): Sulfonating the Product of step (b)

The clear colorless or nearly colorless liquid of step (b) is sulfonated with an equivalent of chlorosulfonic acid using methylene chloride as solvent. The methylene chloride is distilled away.

Step (d): Neutralizing the Product of Step (c)

The product of step (c ) is neutralized with sodium methoxide in methanol and the methanol evaporated to give an improved alkylbenzenesulfonate surfactant system, sodium salt mixture.

EXAMPLE 4

Improved Alkylbenzenesulfonate Surfactant System Prepared via Skeletal Isomerization of Paraffin Step (a i)

A mixture of n-undecane, n-dodecane, n-tridecane, 1:3:1 wt., is isomerized over Pt-SAPO-11 for a conversion better than 90% at a temperature of about 300° C., at 1000 psig under hydrogen gas, with a weight hourly space velocity in the range 2–3 and moles H2/mole hydrocarbon. More detail of such an isomerization is given by S. J. Miller in Microporous Materials, Vol. 2., (1994), 439–449. In further examples the linear starting paraffm mixture can be the same as used in conventional LAB manufacture. Distill to remove any volatiles boiling at up to 40° C./10 mmHg.

Step (a ii)

The paraffin of step (a i) can be dehydrogenated using conventional methods. See, for example, U.S. Pat. No. 5,012,021, Apr. 30, 1991 or U.S. Pat. No. 3,562,797, Feb. 9, 1971. Suitable dehydrogenation catalyst is any of the catalysts disclosed in U.S. Pat. Nos. 3,274,287; 3,315,007; 3,315,008; 3,745,112; 4,430,517; and 3,562,797. For purposes of the present example, dehydrogenation is in accordance with U.S. Pat. No. 3,562,797. The catalyst is zeolite A. The dehydrogenation is conducted in the vapor phase in presence of oxygen (paraffin: dioxygen 1: 1 molar). The temperature is in range 450° C. –550° C. Ratio of grams of catalyst to moles of total feed per hour is 3.9.

Step (b): Alkylating the Product of Step (a) Using an Aromatic Hydrocarbon

To a glass autoclave liner is added 1 mole equivalent of the mixture of step (a), 5 mole equivalents of benzene and 20 wt. %, based on the olefin mixture, of a shape selective zeolite catalyst (acidic mordenite catalyst Zeocat™ FM-8/25H). The glass liner is sealed inside a stainless steel, rocking autoclave. The autoclave is purged twice with 250 psig $N_2$, and then charged to 1000 psig $N_2$. With mixing, the mixture is heated to 170–190° C. overnight for 14–15 hours at which time it is then cooled and removed from the autoclave. The reaction mixture is filtered to remove catalyst. Benzene and any unreacted paraffins are distilled and recycled. A clear colorless or nearly colorless liquid product is obtained.

Step (c): Sulfonating the Product of Step (b)

The product of step (b) is sulfonated with sulfur trioxide/air using no solvent. See U.S. Pat. No. 3,427,342. The molar ratio of sulfur trioxide to alkylbenzene is from about 1.05:1 to about 1.15:1. The reaction stream is cooled and separated from excess sulfur trioxide.

Step (d): Neutralizing the Product of step (c)

The product of step (c ) is neutralized with a slight excess of sodium hydroxide to give an improved alkylbenzenesulfonate surfactant system.

EXAMPLE 5

Improved Alkylbenzenesulfonate Surfactant System Prepared via Specific Tertiary Alcohol Mixture From a Grignard Reaction A mixture of 5-methyl-5-undecanol, 6-methyl-6-dodecanol and 7-methyl-7-tridecanol is prepared via the following Grignard reaction. A mixture of 28 g of 2-hexanone, 28 g of 2-heptanone, 14 g of 2-octanone and 100 g of diethyl ether are added to an addition funnel. The ketone mixture is then added dropwise over a period of 1.75 hours to a nitrogen blanketed stirred three neck round bottom flask, fitted with a reflux condenser and containing 350 mL of 2.0 M hexylmagnesium bromide in diethyl ether and an additional 100 mL of diethyl ether. After the addition is complete, the reaction mixture is stirred an additional 1 hour at 20° C. The reaction mixture is then added to 600 g of a mixture of ice and water with stirring. To this mixture is added 228.6 g of 30% sulfuric acid solution. The resulting two liquid phases are added to a separatory funnel. The aqueous layer is drained and the remaining ether layer is washed twice with 600 mL of water. The ether layer is then evaporated under vacuum to yield 115.45 g of the desired alcohol mixture. A 100 g sample of the light yellow alcohol mixture is added to a glass autoclave liner along with 300 mL of benzene and 20 g of a shape selective zeolite catalyst (acidic mordenite catalyst Zeocat™ FM-8/25H). The glass liner is sealed inside a stainless steel, rocking autoclave. The autoclave is purged twice with 250 psig $N_2$, and then charged to 1000 psig $N_2$. With mixing, the mixture is heated to 170° C. overnight for 14–15 hours at which time it is then cooled and removed from the autoclave. The reaction mixture is filtered to remove catalyst and concentrated by distilling off the benzene which is dried and recycled. A clear colorless or nearly colorless lightly branched olefin mixture is obtained.

50 g of the lightly branched olefin mixture provided by dehydrating the Grignard alcohol mixture as above is added to a glass autoclave liner along with 150 mL of benzene and 10 g of a shape selective zeolite catalyst (acidic mordenite catalyst Zeocat™ FM-8/25H). The glass liner is sealed inside a stainless steel, rocking autoclave. The autoclave is purged twice with 250 psig $N_2$, and then charged to 1000 psig $N_2$. With mixing, the mixture is heated to 195° C. overnight for 14–15 hours at which time it is then cooled and removed from the autoclave. The reaction mixture is filtered to remove catalyst and concentrated by distilling off the benzene which is dried and recycled. A clear colorless or nearly colorless liquid product is obtained. The product is distilled under vacuum (1–5 mm of Hg) and the fraction from 95° C. –135° C. is retained.

The retained fraction, i.e., the clear colorless or nearly colorless liquid, is then sulfonated with a molar equivalent of $SO_3$ and the resulting product is neutralized with sodium methoxide in methanol and the methanol evaporated to give an improved alkylbenzenesulfonate surfactant system.

Hardness Tolerance Test

The alkylaryl sulfonate surfactant systems of the present invention have no more than 40%, preferably no more than 20%, more preferably no more than 10% weight loss as measured by the Hardness Tolerance Test. Details of this test follow: Hardness Tolerance Test—All glassware used is cleaned and dried thoroughly. The sample concentrations used are based on the anhydrous form of the alkylaryl sulfonate surfactant system of the present invention. The experiment is run at 22±1 C.

A 20 g surfactant solution containing 4500 ppm of the sodium salt of the alkylaryl sulfonate surfactant system for which the Hardness Tolerance is to be measured, 5500 ppm sodium tripolyphosphate, 3250 ppm sodium carbonate, and 5295 ppm sodium sulfate is prepared by dissolving each component in de-ionized water at the indicated concentrations. The 20 g surfactant solution is added to 180 g of a 27.8 grain per gallon, 3:1 molar ratio $Ca^{++}$:$Mg^{++}$ hardness solution (prepared from the corresponding sulfate salts). The resulting 200 g test solution is shaken vigorously for 30 seconds and then allowed to stand. After 40 minutes, a 10 mL aliquot of the test solution is filtered through a 0.1 $\mu$M Gelman Acrodisk syringe filter (VWR Scientific, cat. no. 28143-309). The first 2 mL of the filtrate are discarded and the remaining 8 mL of the filtrate are collected for analysis. The surfactant concentration (in ppm) in the collected filtrate, $C_{surf}$, is then measured quantitatively by a suitable analytical technique, e.g., a two-phase titration such as the international standard method ISO 2271 described in Introduction To Surfactant Analysis; Cullum, D.C., Ed.; Blackie Academic and Professional, Glasgow, 1994; pp59–64.

The hardness tolerance result in this test is expressed as the % loss of the surfactant system being tested according to the following formula:

$$\% \text{ loss} = ([450 \text{ ppm} - C_{surf}(\text{ppm})] \div 450 \text{ ppm}) \times 100\%$$

For Example:

| Solution Hardness | A | B |
|---|---|---|
| % Loss | 49% | 8% |

A=a commercial $C_{11-8}$ linear alkylbenzene sulfonate made by the HF process.

B=an alkylarylsulfonate surfactant system of this invention, for example as prepared according to Example 5, containing at least the following crystallinity-disrupted surfactant isomers:

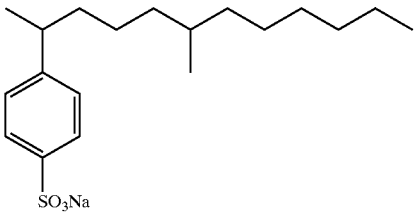

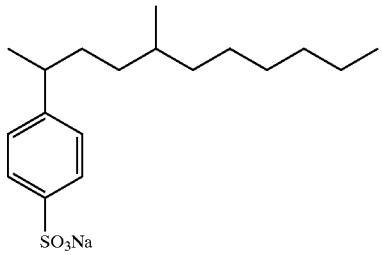

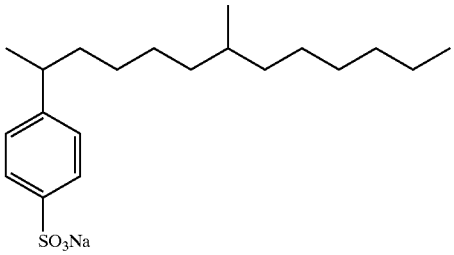

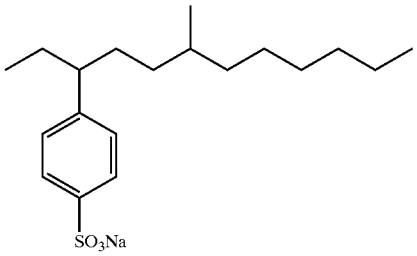

Cleaning Compositions

The surfactant compositions of the present invention can be used in a wide range of consumer cleaning product compositions including powders, liquids, granules, gels, pastes, tablets, pouches, bars, types delivered in dual-compartment containers, spray or foam detergents and other homogeneous or multiphasic consumer cleaning product forms. They can be used or applied by hand and/or can be applied in unitary or freely alterable dosage, or by automatic dispensing means, or are useful in appliances such as washing-machines or dishwashers or can be used in institutional cleaning contexts, including for example, for personal cleansing in public facilities, for bottle washing, for surgical instrument cleaning or for cleaning electronic components. They can have a wide range of pH, for example from about 2 to about 12 or higher, and they can have a wide range of alkalinity reserve which can include very high alkalinity reserves as in uses such as drain unblocking in which tens of grams of NaOH equivalent can be present per 100 grams of formulation, ranging through the 1–10 grams of NaOH equivalent and the mild or low-alkalinity ranges of liquid hand cleaners, down to the acid side such as in acidic hard-surface cleaners. Both high-foaming and low-foaming detergent types are encompassed.

Consumer product cleaning compositions are described in the "Surfactant Science Series", Marcel Dekker, New York, Volumes 1–67 and higher. Liquid compositions in particular are described in detail in the Volume 67, "Liquid Detergents", Ed. Kuo-Yann Lai, 1997, ISBN 0-8247-9391-9 incorporated herein by reference. More classical formulations, especially granular types, are described in "Detergent Manufacture including Zeolite Builders and Other New Materials", Ed. M. Sittig, Noyes Data Corporation, 1979 incorporated by reference. See also Kirk Othmer's Encyclopedia of Chemical Technology.

Consumer product cleaning compositions herein nonlimitingly include:

Light Duty Liquid Detergents (LDL): these compositions include LDL compositions having surfactancy improving magnesium ions (see for example WO 97/00930 A; GB 2,292,562 A; U.S. Pat. No. 5,376,310; U.S. Pat. No. 5,269,974; U.S. Pat. No. 5,230,823; U.S. Pat. No. 4,923,635; U.S. Pat. No. 4,681,704; U.S. Pat. No. 4,316,824; U.S. Pat. No. 4,133,779) and/or organic diamines and/or various foam stabilizers and/or foam boosters such as amine oxides (see for example U.S. Pat. No. 4,133,779) and/or skin feel modifiers of surfactant, emollient and/or enzymatic types including proteases; and/or antimicrobial agents; more comprehensive patent listings are given in Surfactant Science Series, Vol. 67, pages 240–248.

Heavy Duty Liquid Detergents (HDL): these compositions include both the so-called "structured" or multi-phase (see for example U.S. Pat. No. 4,452,717; U.S. Pat. No. 4,526,709; U.S. Pat. No. 4,530,780; U.S. Pat. No. 4,618,446; U.S. Pat. No. 4,793,943; U.S. Pat. No. 4,659,497; U.S. Pat. No. 4,871,467; U.S. Pat. No. 4,891,147; U.S. Pat. No. 5,006,273; U.S. Pat. No. 5,021,195; U.S. Pat. No. 5,147,576; U.S. Pat. No. 5,160,655) and "non-structured" or isotropic liquid types and can in general be aqueous or nonaqueous (see, for example EP 738,778 A; WO 97/00937 A; WO 97/00936 A; EP 752,466 A; DE 19623623 A; WO 96/10073 A; WO 96/10072 A; U.S. Pat. No. 4,647,393; U.S. Pat. No. 4,648,983; U.S. Pat. No. 4,655,954; U.S. Pat. No. 4,661,280; EP 225,654; U.S. Pat. No. 4,690,771; U.S. Pat. No. 4,744,916; U.S. Pat. No. 4,753,750; U.S. Pat. No. 4,950,424; U.S. Pat. No. 5,004,556; U.S. Pat. No. 5,102,574; WO 94/23009; and can be with bleach (see for example U.S. Pat. No. 4,470,919; U.S. Pat. No. 5,250,212; EP 564,250; U.S. Pat. No. 5,264,143; U.S. Pat. No. 5,275,753; U.S. Pat. No. 5,288,746; WO 94/11483; EP 598,170; EP 598,973; EP 619,368; U.S. Pat. No. 5,431,848; U.S. Pat. No. 5,445,756) and/or enzymes (see for example U.S. Pat. No. 3,944,470; U.S. Pat. No. 4,111,855; U.S. Pat. No. 4,261,868; U.S. Pat. No. 4,287,082; U.S. Pat. No. 4,305,837; U.S. Pat. No. 4,404,115; U.S. Pat. No. 4,462,922; U.S. Pat. No. 4,529,5225; U.S. Pat. No. 4,537,706; U.S. Pat. No. 4,537,707; U.S. Pat. No. 4,670,179; U.S. Pat. No. 4,842,758; U.S. Pat. No. 4,900,475; U.S. Pat. No. 4,908,150; U.S. Pat. No. 5,082,585; U.S. Pat. No. 5,156,773; WO 92/19709; EP 583,534; EP 583,535; EP 583,536; WO 94/04542; U.S. Pat. No. 5,269,960; EP 633,311; U.S. Pat. No. 5,422,030; U.S. Pat. No. 5,431,842; U.S. Pat. No. 5,442,100) or without bleach and/or enzymes. Other patents relating to heavy-duty liquid detergents are tabulated or listed in Surfactant Science Series, Vol. 67, pages 309–324.

Heavy Duty Granular Detergents (HDG): these compositions include both the so-called "compact" or agglomerated or otherwise non-spray-dried, as well as the so-called "fluffy" or spray-dried types. Included are both phosphated and nonphosphated types. Such detergents can include the more common anionic-surfactant based types or can be the so-called "high-nonionic surfactant" types in which commonly the nonionic surfactant is held in or on an absorbent such as zeolites or other porous$_{13}$ inorganic salts. Manufacture of HDG's is, for example, disclosed in EP 753,571 A;

WO 96/38531 A; U.S. Pat. No. 5,576,285; U.S. Pat. No. 5,573,697; WO 96/34082 A; U.S. Pat. No. 5,569,645; EP 739,977 A; U.S. Pat. No. 5,565,422; EP 737,739 A; WO 96/27655 A; U.S. Pat. No. 5,554,587; WO 96/25482 A; WO 96/23048 A; WO 96/22352 A; EP 709,449 A; WO 96/09370 A; U.S. Pat. No. 5,496,487; U.S. Pat. No. 5,489,392 and EP 694,608 A.

"Softergents" (STW): these compositions include the various granular or liquid (see for example EP 753,569 A; U.S. Pat. No. 4,140,641; U.S. Pat. No. 4,639,321; U.S. Pat. No. 4,751,008; EP 315,126; U.S. Pat. No. 4,844,821; U.S. Pat. No. 4,844,824; U.S. Pat. No. 4,873,001; U.S. Pat. No. 4,911,852; U.S. Pat. No. 5,017,296; EP 422,787) softening-through-the wash types of product and in general can have organic (e.g., quaternary) or inorganic (e.g., clay) softeners.

Hard Surface Cleaners (HSC): these compositions include all-purpose cleaners such as cream cleansers and liquid all-purpose cleaners; spray all-purpose cleaners including glass and tile cleaners and bleach spray cleaners; and bathroom cleaners including mildew-removing, bleach-containing, antimicrobial, acidic, neutral and basic types. See, for example EP 743,280 A; EP 743,279 A. Acidic cleaners include those of WO 96/34938 A.

Bar Soaps (BS&HW): these compositions include personal cleansing bars as well as so-called laundry bars (see, for example WO 96/35772 A); including both the syndet and soap-based types and types with softener (see U.S. Pat. No. 5,500,137 or WO 96/01889 A); such compositions can include those made by common soap-making techniques such as plodding and/or more unconventional techniques such as casting, absorption of surfactant into a porous support, or the like. Other bar soaps (see for example BR 9502668; WO 96/04361 A; WO 96/04360 A; U.S. Pat. No. 5,540,852) are also included. Other handwash detergents include those such as are described in GB 2,292,155 A and WO 96/01306 A.

Shampoos and Conditioners (S&C): (see, for example WO 96/37594 A; WO 96/17917 A; WO 96/17590 A; WO 96/17591 A). Such compositions in general include both simple shampoos and the so-called "two-in-one" or with conditioner" types.

Liquid Soaps (LS): these compositions include both the so-called "antibacterial" and conventional types, as well as those with or without skin conditioners and include types suitable for use in pump dispensers, and by other means such as wall-held devices used institutionally.

Fabric Softeners (FS): these compositions include both the conventional liquid and liquid concentrate types (see, for example EP 754,749 A; WO 96/21715 A; U.S. Pat. No. 5,531,910; EP 705,900 A; U.S. Pat. No. 5,500,138) as well as dryer-added or substrate-suppoted types (see, for example U.S. Pat. No. 5,562,847; U.S. Pat. No. 5,559,088; EP 704,522 A). Other fabric softeners include solids (see, for example U.S. Pat. No. 5,505,866).

Special Purpose Cleaners (SPC) including home dry cleaning systems (see for example WO 96/30583 A; WO 96/30472 A; WO 96/30471 A; U.S. Pat. No. 5,547,476; WO 96/37652 A); bleach pretreatment products for laundry (see EP 751,210 A); fabric care pretreatment products (see for example EP 752,469 A); liquid fine fabric detergent types, especially the high-foaming variety; rinse-aids for dish-washing; liquid bleaches including both chlorine type and oxygen bleach type, and disinfecting agents, mouthwashes, denture cleaners (see, for example WO 96/19563 A; WO 96/19562 A), car or carpet cleaners or shampoos (see, for example EP 751,213 A; WO 96/15308 A), hair rinses, shower gels, foam baths and personal care cleaners (see, for example WO 96/37595 A; WO 96/37592 A; WO 96/37591 A; WO 96/37589 A; WO 96/37588 A; GB 2,297,975 A; GB 2,297,762 A; GB 2,297,761 A; WO 96/17916 A; WO 96/12468 A) and metal cleaners; as well as cleaning auxiliaries such as bleach additives and "stain-stick" or other pre-treat types including special foam type cleaners (see, for example EP 753,560 A; EP 753,559 A; EP 753,558 A; EP 753,557 A; EP 753,556 A) and anti-sunfade treatments (see WO 96/03486 A; WO 96/03481 A; WO 96/03369 A) are also encompassed. Detergents with enduring perfume (see for example U.S. Pat. No. 5,500,154; WO 96/02490) are increasingly popular.

Laundry or Cleaning Adjunct Materials and Methods:

In general, a laundry or cleaning adjunct is any material required to transform a composition containing only the minimum essential ingredients into a composition useful for laundry or cleaning purposes. Adjuncts in general include stabilizers, diluents, structuring materials, agents having aesthetic effect such as colorants, pro-perfumes and perfumes, and materials having an independent or dependent cleaning function. In preferred embodiments, laundry or cleaning adjuncts are easily recognizable to those of skill in the art as being absolutely characteristic of laundry or cleaning products, especially of laundry or cleaning products intended for direct use by a consumer in a domestic environment.

While not essential for the purposes of the present invention as most broadly defined, several such conventional adjuncts illustrated hereinafter are suitable for use in the instant laundry and cleaning compositions and may be desirably incorporated in preferred embodiments of the invention, for example to assist or enhance cleaning performance, for treatment of the substrate to be cleaned, or to modify the aesthetics of the detergent composition as is the case with perfumes, colorants, dyes or the like. The precise nature of these additional components, and levels of incorporation thereof, will depend on the physical form of the composition and the nature of the cleaning operation for which it is to be used.

Preferably, the adjunct ingredients if used with bleach should have good stability therewith. Certain preferred detergent compositions herein should be boron-free and/or phosphate-free as required by legislation. Levels of adjuncts are from about 0.00001% to about 99.9%, typically from about 70% to about 95%, by weight of the compositions. Use levels of the overall compositions can vary widely depending on the intended application, ranging for example from a few ppm in solution to so-called "direct application" of the neat cleaning composition to the surface to be cleaned.

Common adjuncts include builders, surfactants, enzymes, polymers, bleaches, bleach activators, catalytic materials and the like excluding any materials already defined hereinabove as part of the essential component of the inventive compositions. Other adjuncts herein can include diverse active ingredients or specialized materials such as dispersant polymers (e.g., from BASF Corp. or Rohm & Haas), color speckles, silvercare, anti-tarnish and/or anti-corrosion agents, dyes, fillers, germicides, alkalinity sources, hydrotropes, anti-oxidants, enzyme stabilizing agents, pro-perfumes, perfumes, solubilizing agents, carriers, processing aids, pigments, and, for liquid formulations, solvents, as described in detail hereinafter.

Quite typically, laundry or cleaning compositions herein such as laundry detergents, laundry detergent additives, hard surface cleaners, synthetic and soap-based laundry bars, fabric softeners and fabric treatment liquids, solids and treatment articles of all kinds will require several adjuncts, though certain simply formulated products, such as bleach additives, may require only, for example, a oxygen bleaching agent and a surfactant as described herein. A comprehensive list of suitable laundry or cleaning adjunct materials and methods can be found in U.S. Provisional Patent application No. 60/053,321 filed Jul. 21, 1997 and assigned to Procter & Gamble.

Detersive Surfactants—The instant compositions desirably include a detersive surfactant. Detersive surfactants are extensively illustrated in U.S. Pat. No. 3,929,678, Dec. 30, 1975 Laughlin, et al, and U.S. Pat. No. 4,259,217, Mar. 31, 1981, Murphy; in the series "Surfactant Science", Marcel Dekker, Inc., New York and Basel; in "Handbook of Surfactants", M.R. Porter, Chapman and Hall, 2nd Ed., 1994; in "Surfactants in Consumer Products", Ed. J. Falbe, Springer-Verlag, 1987; and in numerous detergent-related patents assigned to Procter & Gamble and other detergent and consumer product manufacturers.

The detersive surfactant herein therefore includes anionic, nonionic, zwitterionic or amphoteric types of surfactant known for use as cleaning agents in textile laundering, but does not include completely foam-free or completely insoluble surfactants (though these may be used as optional adjuncts). Examples of the type of surfactant considered optional for the present purposes are relatively uncommon as compared with cleaning surfactants but include, for example, the common fabric softener materials such as dioctadecyldimethylammonium chloride.

In more detail, detersive surfactants useful herein, typically at levels from about 1% to about 55%, by weight, suitably include: (1) conventional alkylbenzenesulfonates; (2) olefin sulfonates, including α-olefin sulfonates and sulfonates derived from fatty acids and fatty esters; (3) alkyl or alkenyl sulfosuccinates, including the diester and half-ester types as well as sulfosuccinamates and other sulfonate/carboxylate surfactant types such as the sulfosuccinates derived from ethoxylated alcohols and alkanolamides; (4) paraffin or alkane sulfonate- and alkyl or alkenyl carboxysulfonate- types including the product of adding bisulfite to alpha olefins; (5) alkylnaphthalenesulfonates; (6) alkyl isethionates and alkoxypropanesulfonates, as well as fatty isethionate esters, fatty esters of ethoxylated isethionate and other ester sulfonates such as the ester of 3-hydroxypropanesulfonate or AVANEL S types; (7) benzene, cumene, toluene, xylene, and naphthalene sulfonates, useful especially for their hydrotroping properties; (8) alkyl ether sulfonates; (9) alkyl amide sulfonates; (10) α-sulfo fatty acid salts or esters and internal sulfo fatty acid esters; (11) alkylglycerylsulfonates; (12) ligninsulfonates; (13) petroleum sulfonates, sometimes known as heavy alkylate sulfonates; (14) diphenyl oxide disulfonates; (15) linear or branched alkylsulfates or alkenyl sulfates; (16) alkyl or alkylphenol alkoxylate sulfates and the corresponding polyalkoxylates, sometimes known as alkyl ether sulfates, as well as the alkenylalkoxysulfates or alkenylpolyalkoxy sulfates; (17) alkyl amide sulfates or alkenyl amide sulfates, including sulfated alkanolamides and their alkoxylates and polyalkoxylates; (18) sulfated oils, sulfated alkylglycerides, sulfated alkylpolyglycosides or sulfated sugar-derived surfactants; (19) alkyl alkoxycarboxylates and alkylpolyalkoxycarboxylates, including galacturonic acid salts; (20) alkyl ester carboxylates and alkenyl ester carboxylates; (21) alkyl or alkenyl carboxylates, especially conventional soaps and α,ω-dicarboxylates, including also the alkyl- and alkenylsuccinates; (22) alkyl or alkenyl amide alkoxy-and polyalkoxy-carboxylates; (23) alkyl and alkenyl amidocarboxylate surfactant types, including the sarcosinates, taurides, glycinates, aminopropionates and iminopropionates; (24) amide soaps, sometimes referred to as fatty acid cyanamides; (25) alkylpolyaminocarboxylates; (26) phosphorus-based surfactants, including alkyl or alkenyl phosphate esters, alkyl ether phosphates including their alkoxylated derivatives, phopshatidic acid salts, alkyl phosphonic acid salts, alkyl di(polyoxyalkylene alkanol) phosphates, amphoteric phosphates such as lecithins; and phosphate/carboxylate, phosphate/sulfate and phosphate/sulfonate types; (27) Pluronic-and Tetronic-type nonionic surfactants; (28) the so-called EO/PO Block polymers, including the diblock and triblock EPE and PEP types; (29) fatty acid polyglycol esters; (30) capped and non-capped alkyl or alkylphenol ethoxylates, propoxylates and butoxylates including fatty alcohol polyethyleneglycol ethers; (31) fatty alcohols, especially where useful as viscosity-modifying surfactants or present as unreacted components of other surfactants; (32) N-alkyl polyhydroxy fatty acid amides, especially the alkyl N-alkylglucamides; (33) nonionic surfactants derived from mono- or polysaccharides or sorbitan, especially the alkylpolyglycosides, as well as sucrose fatty acid esters; (34) ethylene glycol-, propylene glycol-, glycerol-and polyglyceryl-esters and their alkoxylates, especially glycerol ethers and the fatty acid/glycerol monoesters and diesters; (35) aldobionamide surfactants; (36) alkyl succinimide nonionic surfactant types; (37) acetylenic alcohol surfactants, such as the SURFYNOLS; (38) alkanolamide surfactants and their alkoxylated derivatives including fatty acid alkanolamides and fatty acid alkanolamide polyglycol ethers; (39) alkylpyrrolidones; (40) alkyl amine oxides, including alkoxylated or polyalkoxylated amine oxides and amine oxides derived from sugars; (41) alkyl phosphine oxides; (42) sulfoxide surfactants; (43) amphoteric sulfonates, especially sulfobetaines; (44) betaine-type amphoterics, including aminocarboxylate-derived types; (45) amphoteric sulfates such as the alkyl ammonio polyethoxysulfates; (46) fatty and petroleum-derived alkylamines and amine salts; (47) alkylimidazolines; (48) alkylamidoamines and their alkoxylate and polyalkoxylate derivatives; and (49) conventional cationic surfactants, including water-soluble alkyltrimethylammonium salts. Moreover, more unusual surfactant types are included, such as: (50) alkylamidoamine oxides, carboxylates and quaternary salts; (51) sugar-derived surfactants modeled after any of the hereinabove-referenced more conventional nonsugar types; (52) fluorosurfactants; (53) biosurfactants; (54) organosilicon surfactants; (55) gemini surfactants, other than the above-referenced diphenyl oxide disulfonates, including those derived from glucose; (56) polymeric surfactants including amphopolycarboxyglycinates; and (57) bolaform surfactants.

Regarding the conventional alkyl benzene sulfonates noted before, especially for substantially linear types including those made using $AlCl_3$ or HF alkylation, suitable chainlengths are from about C10 to about C14. Such linear alkyl benzene sulfonate surfactants can be present in the instant compositions either as a result of being prepared separately and blended in, or as a result of being present in one or more precursors of the essential crystallinity-disrupted surfactants. Ratios of linear and present invention crystallinity-disrupted alkyl benzene sulfonate can vary from 100:1 to 1:100; more typically when using alkyl benzene sulfonates, at least about 0.1 weight fraction, preferably at least about 0.25 weight faction, is the crystallinity-disrupted surfactant of the present invention.

In any of the above detersive surfactants, hydrophobe chain length is typically in the general range $C_8$–$C_{20}$, with chain lengths in the range $C_8$–$C_{18}$ often being preferred, especially when laundering is to be conducted in cool water. Selection of chainlengths and degree of alkoxylation for conventional purposes are taught in the standard texts. When the detersive surfactant is a salt, any compatible cation may be present, including H (that is, the acid or partly acid form of a potentially acidic surfactant may be used), Na, K, Mg, ammonium or alkanolammonium, or combinations of cations. Mixtures of detersive surfactants having different charges are commonly preferred, especially anionic/cationic, anionic/nonionic, anionic/nonionic/catonic, anionic/nonionic/amphoteric, nonionic/cationic and nonionic/amphoteric mixtures. Moreover, any single detersive surfactant may be substituted, often with desirable results for cool water washing, by mixtures of otherwise similar detersive surfactants having differing chainlengths, degree of unsaturation or branching, degree of alkoxylation (especially ethoxylation), insertion of substituents such as ether oxygen atoms in the hydrophobes, or any combinations thereof.

Preferred among the above-identified detersive surfactants are: acid, sodium and ammonium $C_9$–$C_{20}$ linear alkylbenzenesulfonates, particularly sodium linear secondary alkyl $C_{10}$–$C_{15}$ benzenesulfonates (1); olefinsulfonate salts, (2), that is, material made by reacting olefins, particularly $C_{10}$–$C_{20}$ α-olefins, with sulfur trioxide and then neutralizing and hydrolyzing the reaction product; sodium and ammonium $C_7$–$C_{12}$ dialkyl sulfosuccinates, (3); alkane monosulfonates, (4), such as those derived by reacting $C_8$–$C_{20}$ α-olefins with sodium bisulfite and those derived by reacting paraffins with $SO_2$ and $Cl_2$ and then hydrolyzing with a base to form a random sulfonate; α-Sulfo fatty acid salts or esters, (10); sodium alkylglycerylsulfonates, (11), especially those ethers of the higher alcohols derived from tallow or coconut oil and synthetic alcohols derived from petroleum; alkyl or alkenyl sulfates, (15), which may be primary or secondary, saturated or unsaturated, branched or unbranched. Such compounds when branched can be random or regular. When secondary, they preferably have formula $CH_3(CH_2)_x(CHOSO_3^-M^+)\ CH_3$ or $CH_3(CH_2)_y(CHOSO_3^{-M+})\ CH_2CH_3$ where x and (y+1) are integers of at least 7, preferably at least 9 and M is a water-soluble cation, preferably sodium. When unsaturated, sulfates such as oleyl sulfate are preferred, while the sodium and ammonium alkyl sulfates, especially those produced by sulfating $C_8$–$C_{18}$ alcohols, produced for example from tallow or coconut oil are also useful; also preferred are the alkyl or alkenyl ether sulfates, (16), especially the ethoxy sulphates having about 0.5 moles or higher of ethoxylation, preferably from 0.5–8; the alkylethercarboxylates, (19), especially the EO 1–5 ethoxycarboxylates; soaps or fatty acids (21), preferably the more water-soluble types; aminoacid-type surfactants, (23), such as sarcosinates, especially oleyl sarcosinate; phosphate esters, (26); alkyl or alkylphenol ethoxylates, propoxylates and butoxylates, (30), especially the ethoxylates "AE", including the so-called narrow peaked alkyl ethoxylates and $C_6$–$C_{12}$ alkyl phenol alkoxylates as well as the products of aliphatic primary or secondary linear or branched $C_8$–$C_{18}$ alcohols with ethylene oxide, generally 2–30 EO; N-alkyl polyhydroxy fatty acid amides especially the $C_{12}$–$C_{18}$ N-methylglucamides, (32), see WO 9206154, and N-alkoxy polyhydroxy fatty acid amides, such as $C_{10}$–$C_{18}$ N-(3-methoxypropyl) glucamide while N-propyl through N-hexyl $C_{12}$–$C_{18}$ glucamides can be used for low sudsing; alkyl polyglycosides, (33); amine oxides, (40), preferably alkyldimethylamine N- oxides and their dihydrates; sulfobetaines or "sultaines", (43); betaines (44); and gemini surfactants.

Suitable levels of anionic detersive surfactants herein are in the range from about 1% to about 50% or higher, preferably from about 2% to about 30%, more preferably still, from about 5% to about 20% by weight of the detergent composition.

Suitable levels of nonionic detersive surfactant herein are from about 1% to about 40%, preferably from about 2% to about 30%, more preferably from about 5% to about 20%.

Desirable weight ratios of anionic : nonionic surfactants in combination include from 1.0:9.0 to 1.0:0.25, preferably 1.0:1.5 to 1.0:0.4.

Suitable levels of cationic detersive surfactant herein are from about 0.1% to about 20%, preferably from about 1% to about 15%, although much higher levels, e.g., up to about 30% or more, may be useful especially in nonionic:cationic (i.e., limited or anionic-free) formulations.

Amphoteric or zwitterionic detersive surfactants when present are usually useful at levels in the range from about 0.1% to about 20% by weight of the detergent composition. Often levels will be limited to about 5% or less, especially when the amphoteric is costly.

Detersive Enzymes—Enzymes are preferably included in the present detergent compositions for a variety of purposes, including removal of protein-based, carbohydrate-based, or triglyceride-based stains from substrates, for the prevention of refugee dye transfer in fabric laundering, and for fabric restoration. Recent enzyme disclosures in detergents useful herein include bleach/amylase/protease combinations (EP 755,999 A; EP 756,001 A; EP 756,000 A); chondriotinase (EP 747,469 A); protease variants (WO 96/28566 A; WO 96/28557 A; WO 96/28556 A; WO 96/25489 A); xylanase (EP 709,452 A); keratinase (EP 747,470 A); lipase (GB 2,297,979 A; WO 96/16153 A; WO 96/12004 A; EP 698,659 A; WO 96/16154 A); cellulase (GB 2,294,269 A; WO 96/27649 A; GB 2,303,147 A); thermitase (WO 96/28558 A). More generally, suitable enzymes include proteases, amylases, lipases, cellulases, peroxidases, xylanases, keratinases, chondriotinases; thermitases, cutinases and mixtures thereof of any suitable origin, such as vegetable, animal, bacterial, fungal and yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases. Suitable enzymes are also described in U.S. Pat. Nos. 5,677,272, 5,679,630, 5,703,027, 5,703,034, 5,705,464, 5,707,950, 5,707,951, 5,710,115, 5,710,116, 5,710.118, 5,710,119 and 5,721,202.

"Detersive enzyme", as used herein, means any enzyme having a cleaning, stain removing or otherwise beneficial effect in a laundry, hard surface cleaning or personal care detergent composition. Preferred detersive enzymes are hydrolases such as proteases, amylases and lipases. Preferred enzymes for laundry purposes include, but are not limited to, proteases, cellulases, lipases and peroxidases. Highly preferred are amylases and/or proteases, including both current commercially available types and improved types which, though more and more bleach compatible though successive improvements, have a remaining degree of bleach deactivation susceptibility.

Enzymes are normally incorporated into detergent or detergent additive compositions at levels sufficient to provide a "cleaning-effective amount". The term "cleaning effective amount" refers to any amount capable of producing a cleaning, stain removal, soil removal, whitening, deodorizing, or freshness improving effect on substrates such as fabrics, dishware and the like. In practical terms for current commercial preparations, typical amounts are up to about 5 mg by weight, more typically 0.01 mg to 3 mg, of active enzyme per gram of the detergent composition. Stated otherwise, the compositions herein will typically comprise from 0.001% to 5%, preferably 0.01%–1% by weight of a commercial enzyme preparation. Protease enzymes are usually present in such commercial preparations at levels sufficient to provide from 0.005 to 0.1 Anson units (AU) of activity per gram of composition. For certain detergents it may be desirable to increase the active enzyme content of the commercial preparation in order to minimize the total amount of non-catalytically active materials and thereby improve spotting/filming or other end-result. Higher active levels may also be desirable in highly concentrated detergent formulations.

Suitable examples of proteases are the subtilisins which are obtained from particular strains of *B. subtilis* and *B. licheniformis*. One suitable protease is obtained from a strain of Bacillus, having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Other suitable proteases include ALCALASE® and SAVINASE® from Novo and MAXATASE® from International Bio-Synthetics, Inc., The Netherlands; as well as Protease A as disclosed in EP 130,756 A, Jan. 9, 1985 and Protease B as disclosed in EP 303,761 A, Apr. 28, 1987 and EP 130,756 A, Jan. 9, 1985. See also a high pH protease from *Bacillus* sp. NCIMB 40338 described in WO 9318140 A to Novo. Enzymatic detergents comprising protease, one or more other enzymes, and a reversible protease inhibitor are described in WO 9203529 A to Novo. Other preferred proteases include those of WO 9510591 A to Procter & Gamble . When desired, a protease having decreased adsorption and increased hydrolysis is available as described in WO 9507791 to Procter & Gamble. A recombinant trypsin-like protease for detergents suitable herein is described in WO 9425583 to Novo.

In more detail, an especially preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens subtilisin*, as described in WO 95/10615 published Apr. 20, 1995 by Genencor International.

Useful proteases are also described in PCT publications: WO 95/30010 published Nov. 9, 1995 by The Procter & Gamble Company; WO 95/30011 published Nov. 9, 1995 by The Procter & Gamble Company; WO 95/29979 published Nov. 9, 1995 by The Procter & Gamble Company.

Amylases suitable herein include, for example, α-amylases described in GB 1,296,839 to Novo; RAPIDASE®, International Bio-Synthetics, Inc. and TERMAMYL®, Novo. FUNGAMYL® from Novo is especially useful. Engineering of enzymes for improved stability, e.g., oxidative stability, is known. See, for example J. Biological Chem., Vol. 260, No. 11, June 1985, pp. 6518–6521. Certain preferred embodiments of the present compositions can make use of amylases having improved stability in detergents, especially improved oxidative stability as measured against a reference-point of TERMAMYL® in commercial use in 1993. These preferred amylases herein share the characteristic of being "stability-enhanced " amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, measured versus the above-identified reference-point amylase. Stability can be measured using any of the art-disclosed technical tests. See, for example, references disclosed in WO 9402597. Stability-enhanced amylases can be obtained from Novo or from Genencor International. One class of highly preferred amylases herein have the commonality of being derived using site-directed mutagenesis from one or more of the *Bacillus* amylases, especially the *Bacillus* α-amylases, regardless of whether one, two or multiple amylase strains are the immediate precursors. Oxidative stability-enhanced amylases vs. the above-identified reference amylase are preferred for use, especially in bleaching, more preferably oxygen bleaching, as distinct from chlorine bleaching, detergent compositions herein. Such preferred amylases include (a) an amylase according to the hereinbefore incorporated WO 9402597, Novo, Feb. 3, 1994, as further illustrated by a mutant in which substitution is made, using alanine or threonine, preferably threonine, of the methionine residue located in position 197 of the *B. licheniformis* alpha-amylase, known as TERMAMYL®, or the homologous position variation of a similar parent amylase, such as *B. amyloliquefaciens, B. subtilis, or B. stearothermophilus*; (b) stability-enhanced amylases as described by Genencor International in a paper entitled "Oxidatively Resistant alpha-Amylases" presented at the 207th American Chemical Society National Meeting, March 13–17 1994, by C. Mitchinson. Therein it was noted that bleaches in automatic dishwashing detergents inactivate alpha-amylases but that improved oxidative stability amylases have been made by Genencor from *B. licheniformis* NCIB8061. Methionine (Met) was identified as the most likely residue to be modified. Met was substituted, one at a time, in positions 8, 15, 197, 256, 304, 366 and 438 leading to specific mutants, particularly important being M197L and M197T with the M197T variant being the most stable expressed variant. Stability was measured in CASCADE® and SUNLIGHT®; (c) particularly preferred amylases herein include amylase variants having additional modification in the immediate parent as described in WO 9510603 A and are available from the assignee, Novo, as DURAMYL®. Other particularly preferred oxidative stability enhanced amylase include those described in WO 9418314 to Genencor International and WO 9402597 to Novo. Any other oxidative stability-enhanced amylase can be used, for example as derived by site-directed mutagenesis from known chimeric, hybrid or simple mutant parent forms of available amylases. Other preferred enzyme modifications are accessible. See WO 9509909 A to Novo.

Other amylase enzymes include those described in WO 95/26397 and in co-pending application by Novo Nordisk PCT/DK96/00056. Specific amylase enzymes for use in the detergent compositions of the present invention include α-amylses characterized by having a specific activity at least 25% higher than the specific activity of Termamyl® at a temperature range of 25° C. to 55° C. and at a pH value in the range of 8 to 10, measured by the Phadebas® α-amylase activity assay. (Such Phadebas® α-amylase activity assay is described at pages 9–10, WO 95/26397. ) Also included herein are α-amylases which are at least 80% homologous with the amino acid sequences shown in the SEQ ID listings in the references. These enzymes are preferably incorporated into laundry detergent compositions at a level from 0.00018% to 0.060% pure enzyme by weight of the total composition, more preferably from 0.00024% to 0.048% pure enzyme by weight of the total composition.

Cellulases usable herein include both bacterial and fungal types, preferably having a pH optimum between 5 and 9.5. U.S. Pat. No. 4,435,307, Barbesgoard et al, Mar. 6, 1984, discloses suitable fungal cellulases from *Humicola insolens* or *Humicola strain* DSM1800 or a cellulase 212-producing fungus belonging to the genus *Aeromonas*, and cellulase extracted from the hepatopancreas of a marine mollusk, *Dolabella Auricula Solander*. Suitable cellulases are also disclosed in GB-A-2.075.028; GB-A-2.095.275 and DE-OS-2.247.832. CAREZYME® and CELLUZYME® (Novo) are especially useful. See also WO 9117243 to Novo.

Suitable lipase enzymes for detergent usage include those produced by microorganisms of the *Pseudomonas* group, such as *Pseudomonas stutzeri* ATCC 19.154, as disclosed in GB 1,372,034. See also lipases in Japanese Patent Application 53,20487, laid open Feb. 24, 1978. This lipase is available from Amano Pharmaceutical Co. Ltd., Nagoya, Japan, under the trade name Lipase P "Amano," or "Amano-P." Other suitable commercial lipases include Amano-CES, lipases ex *Chromobacter viscosum*, e.g. *Chromobacter viscosum* var. lipolyticum NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli*. LIPOLASE® enzyme derived from *Humicola lanuginosa* and commercially available from Novo, see also EP 341,947, is a preferred lipase for use herein. Lipase and amylase variants stabilized against peroxidase enzymes are described in WO 9414951 A to Novo. See also WO 9205249 and RD 94359044.

Cutinase enzymes suitable for use herein are described in WO 8809367 A to Genencor.

Peroxidase enzymes may be used in combination with oxygen sources, e.g., percarbonate, perborate, hydrogen peroxide, etc., for "solution bleaching" or prevention of transfer of dyes or pigments removed from substrates during the wash to other substrates present in the wash solution. Known peroxidases include horseradish peroxidase, ligninase, and haloperoxidases such as chloro- or bromo-peroxidase. Peroxidase-containing detergent compositions are disclosed in WO 89099813 A, Oct. 19, 1989 to Novo and WO 8909813 A to Novo.

A range of enzyme materials and means for their incorporation into synthetic detergent compositions is also disclosed in WO 9307263 A and WO 9307260 A to Genencor International, WO 8908694 A to Novo, and U.S. Pat. No. 3,553,139, Jan. 5, 1971 to McCarty et al. Enzymes are further disclosed in U.S. Pat. No. 4,101,457, Place et al, Jul. 18, 1978, and in U.S. Pat. No. 4,507,219, Hughes, Mar. 26, 1985. Enzyme materials useful for liquid detergent formulations, and their incorporation into such formulations, are disclosed in U.S. Pat. No. 4,261,868, Hora et al, Apr. 14, 1981. Enzymes for use in detergents can be stabilized by various techniques. Enzyme stabilization techniques are disclosed and exemplified in U.S. Pat. No. 3,600,319, Aug. 17, 1971, Gedge et al, EP 199,405 and EP 200,586, Oct. 29, 1986, Venegas. Enzyme stabilization systems are also described, for example, in U.S. Pat. No. 3,519,570. A useful Bacillus, sp. AC13 giving proteases, xylanases and cellulases, is described in WO 9401532 A to Novo.

Builders—Detergent builders are preferably included in the compositions herein, for example to assist in controlling mineral, especially Ca and/or Mg, hardness in wash water or to assist in the removal and/or suspension of particulate soils from surfaces and sometimes to provide alkalinity and/or buffering action. In solid formulations, builders sometimes serve as absorbents for surfactants. Alternately, certain compositions can be formulated with completely water-soluble builders, whether organic or inorganic, depending on the intended use.

Suitable silicate builders include water-soluble and hydrous solid types and including those having chain-, layer-, or three-dimensional-structure as well as amorphous-solid silicates or other types, for example especially adapted for use in non-structured-liquid detergents. Preferred are alkali metal silicates, particularly those liquids and solids having a $SiO_2$:$Na_2O$ ratio in the range 1.6:1 to 3.2:1, including solid hydrous 2-ratio silicates marketed by PQ Corp. under the tradename BRITESIL®, e.g., BRITESIL H2O; and layered silicates, e.g., those described in U.S. Pat. No. 4,664,839, May 12, 1987, H. P. Rieck. NaSKS-6, sometimes abbreviated "SKS-6", is a crystalline layered aluminum-free $\delta$-$Na_2SiO_5$ morphology silicate marketed by Hoechst and is preferred especially in granular laundry compositions. See preparative methods in German DE-A-3,417,649 and DE-A-3,742,043. Other layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0, can also or alternately be used herein. Layered silicates from Hoechst also include NaSKS-5, NaSKS-7 and NaSKS-11, as the $\alpha$, $\beta$ and $\gamma$ layer-silicate forms. Other silicates may also be useful, such as magnesium silicate, which can serve as a crispening agent in granules, as a stabilizing agent for bleaches, and as a component of suds control systems.

Also suitable for use herein are synthesized crystalline ion exchange materials or hydrates thereof having chain structure and a composition represented by the following general formula in an anhydride form: $xM_2O.ySiO_2.zM'O$ wherein M is Na and/or K, M' is Ca and/or Mg; y/x is 0.5 to 2.0 and z/x is 0.005 to 1.0 as taught in U.S. Pat. No. 5,427,711, Sakaguchi et al, Jun. 27, 1995.

Aluminosilicate builders, such as zeolites, are especially useful in granular detergents, but can also be incorporated in liquids, pastes or gels. Suitable for the present purposes are those having empirical formula: $[M_z(AlO_2)_z(SiO_2)_v].xH_2O$ wherein z and v are integers of at least 6, the molar ratio of z to v is in the range from 1.0 to 0.5, and x is an integer from 15 to 264. Aluminosilicates can be crystalline or amorphous, naturally-occurring or synthetically derived. An aluminosilicate production method is in U.S. Pat. No. 3,985,669, Krummel, et al, Oct. 12, 1976. Preferred synthetic crystalline aluminosilicate ion exchange materials are available as Zeolite A, Zeolite P (B), Zeolite X and, to whatever extent this differs from Zeolite P, the so-called Zeolite MAP. Natural types, including clinoptilolite, may be used. Zeolite A has the formula: $Na_{12}[(AlO_2)_{12}(SiO_2)_{12}].xH_2O$ wherein x is from 20 to 30, especially 27. Dehydrated zeolites (x=0–10) may also be used. Preferably, the aluminosilicate has a particle size of 0.1–10 microns in diameter.

Detergent builders in place of or in addition to the silicates and aluminosilicates described hereinbefore can optionally be included in the compositions herein, for example to assist in controlling mineral, especially Ca and/or Mg, hardness in wash water or to assist in the removal of particulate soils from surfaces. Builders can operate via a variety of mechanisms including forming soluble or insoluble complexes with hardness ions, by ion exchange, and by offering a surface more favorable to the precipitation of hardness ions than are the surfaces of articles to be cleaned. Builder level can vary widely depending upon end use and physical form of the composition. Built detergents typically comprise at least about 1% builder. Liquid formulations typically comprise about 5% to about 50%, more typically 5% to 35% of builder. Granular formulations typically comprise from about 10% to about 80%, more typically 15% to 50% builder by weight of the detergent composition. Lower or higher levels of builders are not excluded. For example, certain detergent additive or high-surfactant formulations can be unbuilt.

Suitable builders herein can be selected from the group consisting of phosphates and polyphosphates, especially the sodium salts; carbonates, bicarbonates, sesquicarbonates and carbonate minerals other than sodium carbonate or sesquicarbonate; organic mono-, di-, tri-, and tetracarboxylates especially water-soluble nonsurfactant carboxylates in acid, sodium, potassium or alkanolammonium salt form, as well as oligomeric or water-soluble low molecular weight polymer carboxylates including aliphatic and aromatic types; and phytic acid. These may be complemented by borates, e.g., for pH-buffering purposes, or by sulfates, especially sodium sulfate and any other fillers or carriers which may be important to the engineering of stable surfactant and/or builder-containing detergent compositions.

Builder mixtures, sometimes termed "builder systems" can be used and typically comprise two or more conventional builders, optionally complemented by chelants, pH-buffers or fillers, though these latter materials are generally accounted for separately when describing quantities of materials herein. In terms of relative quantities of surfactant and builder in the present detergents, preferred builder systems are typically formulated at a weight ratio of surfactant to builder of from about 60:1 to about 1:80. Certain preferred laundry detergents have said ratio in the range 0.90:1.0 to 4.0:1.0, more preferably from 0.95:1.0 to 3.0:1.0.

P-containing detergent builders often preferred where permitted by legislation include, but are not limited to, the alkali metal, ammonium and alkanolammonium salts of polyphosphates exemplified by the tripolyphosphates, pyrophosphates, glassy polymeric meta-phosphates; and phosphonates.

Suitable carbonate builders include alkaline earth and alkali metal carbonates as disclosed in German Patent Application No. 2,321,001 published on Nov. 15, 1973, although sodium bicarbonate, sodium carbonate, sodium sesquicarbonate, and other carbonate minerals such as trona or any convenient multiple salts of sodium carbonate and calcium carbonate such as those having the composition $2Na_2CO_3.CaCO_3$ when anhydrous, and even calcium carbonates including calcite, aragonite and vaterite, especially forms having high surface areas relative to compact calcite may be useful, for example as seeds or for use in synthetic detergent bars.

Suitable "organic detergent builders", as described herein for use with the alkylarylsulfonate surfactant system include polycarboxylate compounds, including water-soluble nonsurfactant dicarboxylates and tricarboxylates. More typically builder polycarboxylates have a plurality of carboxylate groups, preferably at least 3 carboxylates. Carboxylate builders can be formulated in acid, partially neutral, neutral or overbased form. When in salt form, alkali metals, such as sodium, potassium, and lithium, or alkanolammonium salts are preferred. Polycarboxylate builders include the ether polycarboxylates, such as oxydisuccinate, see Berg, U.S. Pat. No. 3,128,287, Apr. 7, 1964, and Lamberti et al, U.S. Pat. No. 3,635,830, Jan. 18, 1972; "TMS/TDS" builders of U.S. Pat. No. 4,663,071, Bush et al, May 5, 1987; and other ether carboxylates including cyclic and alicyclic compounds, such as those described in U.S. Pat. Nos. 3,923,679; 3,835,163; 4,158,635; 4,120,874 and 4,102,903.

Other suitable organic detergent builders are the ether hydroxypolycarboxylates, copolymers of maleic anhydride with ethylene or vinyl methyl ether; 1,3,5-trihydroxy benzene-2,4,6-trisulphonic acid; carboxymethyloxysuccinic acid; the various alkali metal, ammonium and substituted ammonium salts of polyacetic acids such as ethylenediamine tetraacetic acid and nitrilotriacetic acid; as well as mellitic acid, succinic acid, polymaleic acid, benzene 1,3,5-tricarboxylic acid, carboxymethyloxysuccinic acid, and soluble salts thereof.

Citrates, e.g., citric acid and soluble salts thereof are important carboxylate builders e.g., for heavy duty liquid detergents, due to availability from renewable resources and biodegradability. Citrates can also be used in granular compositions, especially in combination with zeolite and/or layered silicates. Oxydisuccinates are also especially useful in such compositions and combinations.

Where permitted, and especially in the formulation of bars used for hand-laundering operations, alkali metal phosphates such as sodium tripolyphosphates, sodium pyrophosphate and sodium orthophosphate can be used. Phosphonate builders such as ethane-1-hydroxy-1,1-diphosphonate and other known phosphonates, e.g., those of U.S. Pat. Nos. 3,159,581; 3,213,030; 3,422,021; 3,400,148 and 3,422,137 can also be used and may have desirable antiscaling properties.

Certain detersive surfactants or their short-chain homologues also have a builder action. For unambiguous formula accounting purposes, when they have surfactant capability, these materials are summed up as detersive surfactants. Preferred types for builder functionality are illustrated by: 3,3-dicarboxy-4-oxa-1,6-hexanedioates and the related compounds disclosed in U.S. Pat. No. 4,566,984, Bush, Jan. 28, 1986. Succinic acid builders include the $C_5$–$C_{20}$ alkyl and alkenyl succinic acids and salts thereof. Succinate builders also include: laurylsuccinate, myristylsuccinate, palmitylsuccinate, 2-dodecenylsuccinate (preferred), 2-pentadecenylsuccinate, and the like. Lauryl-succinates are described in European Patent Application 86200690.5/0, 200,263, published Nov. 5, 1986. Fatty acids, e.g., $C_{12}$–$C_{18}$ monocarboxylic acids, can also be incorporated into the compositions as surfactant/builder materials alone or in combination with the aforementioned builders, especially citrate and/or the succinate builders, to provide additional builder activity. Other suitable polycarboxylates are disclosed in U.S. Pat. No. 4,144,226, Crutchfield et al, Mar. 13, 1979 and in U.S. Pat. No. 3,308,067, Diehl, Mar. 7, 1967. See also Diehl, U.S. Pat. No. 3,723,322.

Other types of inorganic builder materials which can be used have the formula $(M_x)_i\ Ca_y\ (CO_3)_z$ wherein x and i are integers from 1 to 15, y is an integer from 1 to 10, z is an integer from 2 to 25, $M_i$ are cations, at least one of which is a water-soluble, and the equation $\Sigma_i=_{1\text{-}15}$ ($x_i$ multiplied by the valence of $M_i$)+2y=2z is satisfied such that the formula has a neutral or "balanced" charge. These builders are referred to herein as "Mineral Builders", examples of these builders, their use and preparation can be found in U.S. Pat. No. 5,707,959. Another suitable class of inorganic builders are the Magnesiosilicates, see WO 97/0179.

Oxygen Bleaching Agents:

Preferred compositions of the present invention comprise, as part or all of the laundry or cleaning adjunct materials, an "oxygen bleaching agent". Oxygen bleaching agents useful in the present invention can be any of the oxidizing agents known for laundry, hard surface cleaning, automatic dishwashing or denture cleaning purposes. Oxygen bleaches or mixtures thereof are preferred, though other oxidant bleaches, such as oxygen, an enzymatic hydrogen peroxide producing system, or hypohalites such as chlorine bleaches like hypochlorite, may also be used.

Common oxygen bleaches of the peroxygen type include hydrogen peroxide, inorganic peroxohydrates, organic peroxohydrates and the organic peroxyacids, including hydrophilic and hydrophobic mono- or di- peroxyacids. These can be peroxycarboxylic acids, peroxyimidic acids, amidoperoxycarboxylic acids, or their salts including the calcium, magnesium, or mixed-cation salts. Peracids of various kinds can be used both in free form and as precursors known as "bleach activators" or "bleach promoters" which, when combined with a source of hydrogen peroxide, perhydrolyze to release the corresponding peracid.

Also useful herein as oxygen bleaches are the inorganic peroxides such as $Na_2O_2$, superoxides such as $KO_2$, organic hydroperoxides such as cumene hydroperoxide and t-butyl hydroperoxide, and the inorganic peroxoacids and their salts such as the peroxosulfuric acid salts, especially the potassium salts of peroxodisulfuric acid and, more preferably, of peroxomonosulfuric acid including the commercial triple-salt form sold as OXONE by DuPont and also any equivalent commercially available forms such as CUROX from Akzo or CAROAT from Degussa. Certain organic peroxides, such as dibenzoyl peroxide, may be useful, especially as additives rather than as primary oxygen bleach.

Mixed oxygen bleach systems are generally useful, as are mixtures of any oxygen bleaches with the known bleach activators, organic catalysts, enzymatic catalysts and mixtures thereof; moreover such mixtures may further include brighteners, photobleaches and dye transfer inhibitors of types well-known in the art.

Preferred oxygen bleaches, as noted, include the peroxohydrates, sometimes known as peroxyhydrates or peroxohydrates. These are organic or, more commonly, inorganic salts capable of releasing hydrogen peroxide readily. Peroxohydrates are the most common examples of "hydrogen peroxide source" materials and include the perborates, percarbonates, perphosphates, and persilicates. Suitable peroxohydrates include sodium carbonate peroxyhydrate and equivalent commercial "percarbonate" bleaches, and any of the so-called sodium perborate hydrates, the "tetrahydrate" and "monohydrate" being preferred; though sodium pyrophosphate peroxyhydrate can be used. Many such peroxohydrates are available in processed forms with coatings, such as of silicate and/or borate and/or waxy materials and/or surfactants, or have particle geometries, such as compact spheres, which improve storage stability. By way of organic peroxohydrates, urea peroxyhydrate can also be useful herein.

Percarbonate bleach includes, for example, dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Percarbonates and perborates are widely available in commerce, for example from FMC, Solvay and Tokai Denka.

Organic percarboxylic acids useful herein as the oxygen bleach include magnesium monoperoxyphthalate hexahydrate, available from Interox, m-chloro perbenzoic acid and its salts, 4-nonylamino-4-oxoperoxybutyric acid and diperoxydodecanedioic acid and their salts. Such bleaches are disclosed in U.S. Pat. No. 4,483,781, U.S. Pat. Appl. 740,446, Bums et al, filed Jun. 3, 1985, EP-A 133,354, published Feb. 20, 1985, and U.S. Pat. No. 4,412,934. Organic percarboxylic acids usable herein include those containing one, two or more peroxy groups, and can be aliphatic or aromatic. Highly preferred oxygen bleaches also include 6-nonylamino-6-oxoperoxycaproic acid (NAPAA) as described in U.S. Pat. No. 4,634,551.

An extensive and exhaustive listing of useful oxygen bleaches, including inorganic peroxohydrates, organic peroxohydrates and the organic peroxyacids, including hydrophilic and hydrophobic mono- or di- peroxyacids, peroxycarboxylic acids, peroxyimidic acids, amidoperoxycarboxylic acids, or their salts including the calcium, magnesium, or mixed-cation salts, can be found in U.S. Pat. No. 5,622,646 and 5,686,014.

Other useful peracids and bleach activators herein are in the family of imidoperacids and imido bleach activators. These include phthaloylimidoperoxycaproic acid and related arylimido-substituted and acyloxynitrogen derivatives. For listings of such compounds, preparations and their incorporation into laundry compositions including both granules and liquids, See U.S. Pat. Nos. 5,487,818; U.S. Pat. No. 5,470,988, U.S. Pat. No. 5,466,825; U.S. Pat. No. 5,419,846; U.S. Pat. No. 5,415,796; U.S. Pat. No. 5,391,324; U.S. Pat. No. 5,328,634; U.S. Pat. No. 5,310,934; U.S. Pat. No. 5,279,757; U.S. Pat. No. 5,246,620; U.S. Pat. No. 5,245,075; U.S. Pat. No. 5,294,362; U.S. Pat. No. 5,423,998; U.S. Pat. No. 5,208,340; U.S. Pat. No. 5,132,431 and 5,087,385.

Useful diperoxyacids include, for example, 1,12-diperoxydodecanedioic acid (DPDA); 1,9-diperoxyazelaic acid; diperoxybrassilic acid; diperoxysebasic acid and diperoxyisophthalic acid; 2-decyldiperoxybutane-1,4-dioic acid; and 4,4'-sulphonylbisperoxybenzoic acid.

More generally, the terms "hydrophilic" and "hydrophobic" used herein in connection with any of the oxygen bleaches, especially the peracids, and in connection with bleach activators, are in the first instance based on whether a given oxygen bleach effectively performs bleaching of fugitive dyes in solution thereby preventing fabric graying and discoloration and/or removes more hydrophilic stains such as tea, wine and grape juice—in this case it is termed "hydrophilic". When the oxygen bleach or bleach activator has a significant stain removal, whiteness-improving or cleaning effect on dingy, greasy, carotenoid, or other hydrophobic soils, it is termed "hydrophobic". The terms are applicable also when referring to peracids or bleach activators used in combination with a hydrogen peroxide source. The current commercial benchmarks for hydrophilic performance of oxygen bleach systems are: TAED or peracetic acid, for benchmarking hydrophilic bleaching. NOBS or NAPAA are the corresponding benchmarks for hydrophobic bleaching. The terms "hydrophilic", "hydrophobic" and "hydrotropic" with reference to oxygen bleaches including peracids and here extended to bleach activator have also been used somewhat more narrowly in the literature. See especially Kirk Othmer's Encyclopedia of Chemical Technology, Vol. 4., pages 284–285. This reference provides a chromatographic retention time and critical micelle concentration-based set of criteria, and is useful to identify and/or characterize preferred sub-classes of hydrophobic, hydrophilic and hydrotropic oxygen bleaches and bleach activators that can be used in the present invention.

Bleach Activators

Bleach activators useful herein include amides, imides, esters and anhydrides. Commonly at least one substituted or unsubstituted acyl moiety is present, covalently connected to a leaving group as in the structure R—C(O)—L. In one preferred mode of use, bleach activators are combined with a source of hydrogen peroxide, such as the perborates or percarbonates, in a single product. Conveniently, the single product leads to in situ production in aqueous solution (i.e., during the washing process) of the percarboxylic acid corresponding to the bleach activator. The product itself can be hydrous, for example a powder, provided that water is controlled in amount and mobility such that storage stability is acceptable. Alternately, the product can be an anhydrous solid or liquid. In another mode, the bleach activator or oxygen bleach is incorporated in a pretreatment product, such as a stain stick; soiled, pretreated substrates can then be exposed to further treatments, for example of a hydrogen peroxide source. With respect to the above bleach activator structure RC(O)L, the atom in the leaving group connecting to the peracid-forming acyl moiety R(C)O— is most typically O or N. Bleach activators can have non-charged, positively or negatively charged peracid-forming moieties and/or noncharged, positively or negatively charged leaving groups. One or more peracid-forming moieties or leaving-groups can be present. See, for example, U.S. Pat. No. 5,595,967, U.S. Pat. No. 5,561,235, U.S. Pat. No. 5,560,862 or the bis-(peroxy-carbonic) system of U.S. Pat. No. 5,534,179. Mixtures of suitable bleach activators can also be used. Bleach activators can be substituted with electron-donating or electron-releasing moieties either in the leaving-group or in the peracid-forming moiety or moieties, changing their reactivity and making them more or less suited to particular pH or wash conditions. For example, electron-witdrawing groups such as $NO_2$ improve the efficacy of bleach activators intended for use in mild-pH (e.g., from about 7.5- to about 9.5) wash conditions.

An extensive and exhaustive disclosure of suitable bleach activators and suitable leaving groups, as well as how to determine suitable activators, can be found in U.S. Pat. Nos. 5,686,014 and 5,622,646.

Cationic bleach activators include quaternary carbamate-, quaternary carbonate-, quaternary ester- and quaternary amide- types, delivering a range of cationic peroxyimidic, peroxycarbonic or peroxycarboxylic acids to the wash. An analogous but non-cationic palette of bleach activators is available when quaternary derivatives are not desired. In more detail, cationic activators include quaternary ammonium-substituted activators of WO 96–06915, U.S. Pat. No. 4,751,015 and 4,397,757, EP-A-284292, EP-A-331,229 and EP-A-03520. Also useful are cationic nitrites as disclosed in EP-A-303,520 and in European Patent Specification 458,396 and 464,880. Other nitrile types have electron-withdrawing substituents as described in U.S. Pat. No. 5,591,378.

Other bleach activator disclosures include GB 836,988; 864,798; 907,356; 1,003,310 and 1,519,351; German Patent 3,337,921; EP-A-0185522; EP-A-0174132; EP-A-0120591; U.S. Pat. Nos. 1,246,339; 3,332,882; 4,128,494; 4,412,934 and 4,675,393, and the phenol sulfonate ester of alkanoyl aminoacids disclosed in U.S. Pat. No. 5,523,434. Suitable bleach activators include any acetylated diamine types, whether hydrophilic or hydrophobic in character.

Of the above classes of bleach precursors, preferred classes include the esters, including acyl phenol sulfonates, acyl alkyl phenol sulfonates or acyl oxybenzenesulfonates (OBS leaving-group); the acyl-amides; and the quaternary ammonium substituted peroxyacid precursors including the cationic nitrites.

Preferred bleach activators include N,N,N'N'-tetraacetyl ethylene diamine (TAED) or any of its close relatives including the triacetyl or other unsymmetrical derivatives. TAED and the acetylated carbohydrates such as glucose pentaacetate and tetraacetyl xylose are preferred hydrophilic bleach activators. Depending on the application, acetyl triethyl citrate, a liquid, also has some utility, as does phenyl benzoate.

Preferred hydrophobic bleach activators include sodium nonanoyloxybenzene sulfonate (NOBS or SNOBS), N-(alkanoyl)aminoalkanoyloxy benzene sulfonates, such as 4-[N-(nonanoyl)aminohexanoyloxy]-benzene sulfonate or (NACA-OBS) as described in U.S. Pat. No. 5,534,642 and in EPA 0 355 384 A1, substituted amide types described in detail hereinafter, such as activators related to NAPAA, and activators related to certain imidoperacid bleaches, for example as described in U.S. Pat. No. 5,061,807, issued Oct. 29, 1991 and assigned to Hoechst Aktiengesellschaft of Frankfurt, Germany and Japanese Laid-Open Patent Application (Kokai) No. 4-28799.

Another group of peracids and bleach activators herein are those derivable from acyclic imidoperoxycarboxylic acids and salts thereof, See U.S. Pat. No. 5415796, and cyclic imidoperoxycarboxylic acids and salts thereof, see U.S. Pat. Nos. 5,061,807, 5,132,431, 5,6542,69, 5,246,620, 5,419,864 and 5,438,147.

Other suitable bleach activators include sodium-4-benzoyloxy benzene sulfonate (SBOBS); sodium-1-methyl-2-benzoyloxy benzene-4-sulphonate; sodium-4-methyl-3-benzoyloxy benzoate (SPCC); trimethyl ammonium toluyloxy-benzene sulfonate; or sodium 3,5,5-trimethyl hexanoyloxybenzene sulfonate (STHOBS).

Bleach activators may be used in an amount of up to 20%, preferably from 0.1–10% by weight, of the composition, though higher levels, 40% or more, are acceptable, for example in highly concentrated bleach additive product forms or forms intended for appliance automated dosing.

Highly preferred bleach activators useful herein are amide-substituted and an extensive and exhaustive disclosure of these activators can be found in U.S. Pat. Nos. 5,686,014 and 5,622,646.

Other useful activators, disclosed in U.S. Pat. No. 4,966,723, are benzoxazin-type, such as a $C_6H_4$ ring to which is fused in the 1,2-positions a moiety—C(O)OC($R^1$)═N—. A highly preferred activator of the benzoxazin-type is:

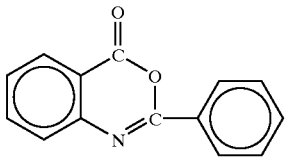

Depending on the activator and precise application, good bleaching results can be obtained from bleaching systems having with in-use pH of from about 6 to about 13, preferably from about 9.0 to about 10.5. Typically, for example, activators with electron-withdrawing moieties are used for near-neutral or sub-neutral pH ranges. Alkalis and buffering agents can be used to secure such pH.

Acyl lactam activators are very useful herein, especially the acyl caprolactams (see for example WO 94-28102 A) and acyl valerolactams (see U.S. Pat. No. 5,503,639). See also U.S. Pat. No. 4,545,784 which discloses acyl caprolactams, including benzoyl caprolactam adsorbed into sodium perborate. In certain preferred embodiments of the invention, NOBS, lactam activators, imide activators or amide-functional activators, especially the more hydrophobic derivatives, are desirably combined with hydrophilic activators such as TAED, typically at weight ratios of hydrophobic activator: TAED in the range of 1:5 to 5:1, preferably about 1:1. Other suitable lactam activators are alpha-modified, see WO 96-22350 A1, Jul. 25, 1996. Lactam activators, especially the more hydrophobic types, are desirably used in combination with TAED, typically at weight ratios of amido-derived or caprolactam activators : TAED in the range of 1:5 to 5:1, preferably about 1:1. See also the bleach activators having cyclic amidine leaving-group disclosed in U.S. Pat. No. 5,552,556.

Nonlimiting examples of additional activators useful herein are to be found in U.S. Pat. No. 4,915,854, U.S. Pat. Nos. 4,412,934 and 4,634,551. The hydrophobic activator nonanoyloxybenzene sulfonate (NOBS) and the hydrophilic tetraacetyl ethylene diamine (TAED) activator are typical, and mixtures thereof can also be used.

Additional activators useful herein include those of U.S. 5,545,349.

Transition Metal Bleach Catalysts:

If desired, the bleaching compounds can be catalyzed by means of a manganese compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; European Pat. App. Pub. Nos. 549,271A1, 549,272A1, 544,440A2, 544,490A1; and PCT applications PCT/IB98/00298, PCT/IB98/00299, PCT/IB98/00300, and PCT/IB98/00302; Preferred examples of these catalysts include $Mn^{IV}{}_2(u\text{-}O)_3(1,4,7\text{-trimethyl-}1,4,7\text{-triazacyclononane})_2(PF_6)_2$, $Mn^{III}{}_2(u\text{-}O)_1(u\text{-}OAc)_2(1,4,7\text{-trimethyl-}1,4,7\text{-triazacyclononane})_2(ClO_4)_2$, $Mn_{IV4}(u\text{-}O)_6(1,4,7\text{-triazacyclononane})_4(ClO_4)_4$, $Mn^{III}Mn^{IV}{}_4(u\text{-}O)_1(u\text{-}OAc)_2\text{-}(1,4,7\text{-trimethyl-}1,4,7\text{-triazacyclononane})_2(ClO_4)_3$, $Mn^{IV}(1,4,7\text{-trimethyl-}1,4,7\text{-tri-azacyclononane})\text{-}(OCH_3)_3(PF_6)$, and mixtures thereof. Other metal-based bleach catalysts include those disclosed in U.S. Pat. Nos. 4,430,243, 5,114,611 5,622,646 and 5,686,014. The use of manganese with various complex ligands to enhance bleaching is also reported in the following U.S. Pat. Nos. 4,728,455; 5,284,944; 5,246,612; 5,256,779; 5,280,117; 5,274,147; 5,153,161; and 5,227,084.

Cobalt bleach catalysts useful herein are known, and are described, for example, in M. L. Tobe, "Base Hydrolysis of Transition-Metal Complexes", *Adv. Inorg. Bioinorg. Mech.*, (1983), 2, pages 1–94. The most preferred cobalt catalyst useful herein are cobalt pentaamine acetate salts having the formula $[Co(NH_3)_5OAc]\ T_y$, wherein "OAc" represents an acetate moiety and "$T_y$" is an anion, and especially cobalt pentaamine acetate chloride, $[Co(NH_3)_5OAc]Cl_2$; as well as $[Co(NH_3)_5OAc](OAc)_2$; $[Co(NH_3)_5OAc](PF_6)_2$; $[Co(NH_3)_5OAc](SO_4)$; $[Co(NH_3)_5OAc](BF_4)_2$; and $[Co(NH_3)_5OAc](NO_3)_2$ (herein "PAC"). These cobalt catalysts are readily prepared by known procedures, such as taught for example in the Tobe article and the references cited therein, and in U.S. Pat. No. 4,810,410, to Diakun et al, issued Mar. 7,1989.

Compositions herein may also suitably include as a bleach catalyst the class of transition metal complexes of a macropolycyclic rigid ligand. The phrase "macropolycyclic rigid ligand" is sometimes abbreviated as "MRL". One useful MRL is [MnByclamCl2], where "Bcyclam" is (5,12-dimethyl-1,5,8,12-tetraaza-bicyclo [6.6.2]hexadecane). See PCT applications PCT/IB98/00298, PCT/IB98/00299, PCT/IB98/00300, and PCT/IB98/00302. The amount used is a catalytically effective amount, suitably about 1 ppb or more, for example up to about 99.9%, more typically about 0.001 ppm or more, preferably from about 0.05 ppm to about 500 ppm (wherein "ppb" denotes parts per billion by weight and "ppm" denotes parts per million by weight).

As a practical matter, and not by way of limitation, the compositions and cleaning processes herein can be adjusted to provide on the order of at least one part per hundred million of the active bleach catalyst species in the aqueous washing medium, and will preferably provide from about 0.01 ppm to about 25 ppm, more preferably from about 0.05 ppm to about 10 ppm, and most preferably from about 0.1 ppm to about 5 ppm, of the bleach catalyst species in the wash liquor. In order to obtain such levels in the wash liquor of an automatic washing process, typical compositions herein will comprise from about 0.0005% to about 0.2%, more preferably from about 0.004% to about 0.08%, of bleach catalyst, especially manganese or cobalt catalysts, by weight of the cleaning compositions.

Enzymatic Sources of Hydrogen Peroxide

On a different track from the bleach activators illustrated hereinabove, another suitable hydrogen peroxide generating system is a combination of a $C_1$–$C_4$ alkanol oxidase and a $C_1$–$C_4$ alkanol, especially a combination of methanol oxidase (MOX) and ethanol. Such combinations are disclosed in WO 94/03003. Other enzymatic materials related to bleaching, such as peroxidases, haloperoxidases, oxidases, superoxide dismutases, catalases and their enhancers or, more commonly, inhibitors, may be used as optional ingredients in the instant compositions.

Oxygen Transfer Agents and Precursors

Also useful herein are any of the known organic bleach catalysts, oxygen transfer agents or precursors therefor. These include the compounds themselves and/or their precursors, for example any suitable ketone for production of dioxiranes and/or any of the hetero-atom containing analogs of dioxirane precursors or dioxiranes, such as sulfonimines $R^1R^2C{=}NSO_2R^3$, see EP 446 982 A, published 1991 and sulfonyloxaziridines, see EP 446,981 A, published 1991. Preferred examples of such materials include hydrophilic or hydrophobic ketones, used especially in conjunction with monoperoxysulfates to produce dioxiranes in situ, and/or the imines described in U.S. Pat. No. 5,576,282 and references described therein. Oxygen bleaches preferably used in conjunction with such oxygen transfer agents or precursors include percarboxylic acids and salts, percarbonic acids and salts, peroxymonosulfuric acid and salts, and mixtures thereof. See also U.S. Pat. No. 5,360,568; U.S. Pat. No. 5,360,569; U.S. Pat. No. 5,370,826 and U.S. Pat. No. 5,442,066.

Although oxygen bleach systems and/or their precursors may be susceptible to decomposition during storage in the presence of moisture, air (oxygen and/or carbon dioxide) and trace metals (especially rust or simple salts or colloidal oxides of the transition metals) and when subjected to light, stability can be improved by adding common sequestrants (chelants) and/or polymeric dispersants and/or a small amount of antioxidant to the bleach system or product. See, for example, U.S. Pat. No. 5,545,349. Antioxidants are often added to detergent ingredients ranging from enzymes to surfactants. Their presence is not necessarily inconsistent with use of an oxidant bleach; for example, the introduction of a phase barrier may be used to stabilize an apparently incompatible combination of an enzyme and antioxidant, on one hand, and an oxygen bleach, on the other. Although commonly known substances can be used as antioxidants, For example see U.S. Pat. Nos. 5,686,014, 5,622,646, 5,055, 218, 4,853,143, 4,539,130 and 4,483,778. Preferred antioxidants are 3,5-di-tert-butyl-4-hydroxytoluene, 2,5-di-tert-butylhydroquinone and D,L-alpha-tocopherol.

Polymeric Soil Release Agent—The compositions according to the present invention may optionally comprise one or more soil release agents. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of the laundry cycle and , thus, serve as an anchor for the hydrophilic segments. This can enable stains occurring subsequent to treatment with the soil release agent to be more easily cleaned in later washing procedures.

If utilized, soil release agents will generally comprise from about 0.01% to about 10% preferably from about 0.1% to about 5%, more preferably from about 0.2% to about 3% by weight, of the composition.

The following, all included herein by reference, describe soil release polymers suitable for us in the present invention. U.S. Pat. No. 5,691,298 Gosselink et al., issued Nov. 25, 1997; U.S. Pat. No. 5,599,782 Pan et al., issued Feb. 4, 1997; U.S. Pat. No. 5,415,807 Gosselink et al., issued May 16, 1995; U.S. Pat. No. 5,182,043 Morrall et al., issued Jan. 26, 1993; U.S. Pat. No. 4,956,447 Gosselink et al., issued Sep. 11, 1990; U.S. Pat. No. 4,976,879 Maldonado et al. issued Dec. 11, 1990; U.S. Pat. No. 4,968,451 Scheibel et al., issued Nov. 6, 1990; U.S. Pat. No. 4,925,577 Borcher, Sr. et al., issued May 15, 1990; U.S. Pat. No. 4,861,512 Gosselink, issued Aug. 29, 1989; U.S. Pat. No. 4,877,896 Maldonado et al., issued Oct. 31, 1989; U.S. Pat. No. 4,702,857 Gosselink et al., issued Oct. 27, 1987; U.S. Pat. No. 4,711,730 Gosselink et al., issued Dec. 8, 1987; U.S. Pat. No. 4,721,580 Gosselink issued Jan. 26, 1988; U.S. Pat. No. 4,000,093 Nicol et al., issued Dec. 28, 1976; U.S. Pat. No. 3,959,230Hayes, issued May 25, 1976; U.S. Pat. No. 3,893,929 Basadur, issued Jul. 8, 1975; and European Patent Application 0 219 048, published Apr. 22, 1987 by Kud et al.

Further suitable soil release agents are described in U.S. Pat. No. 4,201,824 Voilland et al.; U.S. Pat. No. 4,240,918 Lagasse et al.; U.S. Pat. No. 4,525,524 Tung et al.; U.S. Pat. No. 4,579,681 Ruppert et al.; U.S. Pat. No. 4,220,918; U.S. Pat. No. 4,787,989; EP 279,134 A, 1988 to Rhone-Poulenc Chemie; EP 457,205 A to BASF (1991); and DE 2,335,044 to Unilever N.V., 1974; all incorporated herein by reference.

Clay Soil Removal/Anti-redeposition Agents—The compositions of the present invention can also optionally contain water-soluble ethoxylated amines having clay soil removal and antiredeposition properties. Granular detergent compositions which contain these compounds typically contain from about 0.01% to about 10.0% by weight of the water-soluble ethoxylated amines; liquid detergent compositions typically contain about 0.01% to about 5%.

A preferred soil release and anti-redeposition agent is ethoxylated tetraethylene pentamine. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. See U.S. Pat. No. 4,891,160, VanderMeer, issued Jan. 2, 1990 and WO 95/32272, published Nov. 30, 1995. Another type of preferred antiredeposition agent includes the carboxy methyl cellulose (CMC) materials. These materials are well known in the art.

Polymeric Dispersing Agents—Polymeric dispersing agents can advantageously be utilized at levels from about 0.1% to about 7%, by weight, in the compositions herein, especially in the presence of zeolite and/or layered silicate builders. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release, peptization, and anti-redeposition.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Other polymer types which may be more desirable for biodegradability, improved bleach stability, or cleaning purposes include various terpolymers and hydrophobically modified copolymers, including those marketed by Rohm & Haas, BASF Corp., Nippon Shokubai and others for all manner of water-treatment, textile treatment, or detergent applications.

Brightener—Any optical brighteners or other brightening or whitening agents known in the art can be incorporated at levels typically from about 0.01% to about 1.2%, by weight, into the detergent compositions herein when they are designed for fabric washing or treatment.

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Arctic White CC and Arctic White CWD, the 2-(4-styryl-phenyl)-2H-naptho[1,2-d] triazoles; 4,4'-bis-(1,2,3-triazol-2-yl)-stilbenes; 4,4'-bis (styryl)bisphenyls; and the aminocoumanns. Specific examples of these brighteners include 4-methyl-7-diethyl-amino coumarin; 1,2-bis(benzimidazol-2-yl)ethylene; 1,3-diphenyl-pyrazolines; 2,5-bis(benzoxazol-2-yl)thiophene; 2-styryl-naptho[1,2-d]oxazole; and 2-(stilben-4-yl)-2H-naphtho[1,2-d]triazole. See also U.S. Pat. No. 3,646,015, issued Feb. 29, 1972 to Hamilton.

Dye Transfer Inhibiting Agents—The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

Chelating Agents—The detergent compositions herein may also optionally contain one or chelating agents, particularly chelating agents for adventitious transition metals. Those commonly found in wash water include iron and/or manganese in water-soluble, colloidal or particulate form, and may be associated as oxides or hydroxides, or found in association with soils such as humic substances. Preferred chelants are those which effectively control such transition metals, especially including controlling deposition of such transition-metals or their compounds on fabrics and/or controlling undesired redox reactions in the wash medium and/or at fabric or hard surface interfaces. Such chelating agents include those having low molecular weights as well as polymeric types, typically having at least one, preferably two or more donor heteroatoms such as 0 or N, capable of co-ordination to a transition-metal, Common chelating agents can be selected from the group consisting of aminocarboxylates, aminophosphonates, polyfunctionally-substituted aromatic chelating agents and mixtures thereof.

If utilized, chelating agents will generally comprise from about 0.001% to about 15% by weight of the detergent compositions herein. More preferably, if utilized, chelating agents will comprise from about 0.01% to about 3.0% by weight of such compositions.

Suds Suppressors—Compounds for reducing or suppressing the formation of suds can be incorporated into the compositions of the present invention when required by the intended use, especially washing of laundry in washing appliances. Other compositions, such as those designed for hand-washing, may desirably be high-sudsing and may omit such ingredients Suds suppression can be of particular importance in the so-called "high concentration cleaning process" as described in U.S. Pat. Nos. 4,489,455 and 4,489,574 and in front-loading European-style washing machines.

A wide variety of materials may be used as suds suppressors and are well known in the art. See, for example, Kirk Othmer Encyclopedia of Chemical Technology, Third Edition, Volume 7, pages 430–447 (Wiley, 1979).

The compositions herein will generally comprise from 0% to about 10% of suds suppressor. When utilized as suds suppressors, monocarboxylic fatty acids, and salts thereof, will be present typically in amounts up to about 5%, preferably 0.5%–3% by weight, of the detergent composition although higher amounts may be used. Preferably from about 0.01% to about 1% of silicone suds suppressor is used, more preferably from about 0.25% to about 0.5%. These weight percentage values include any silica that may be utilized in combination with polyorganosiloxane, as well as any suds suppressor adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

Alkoxylated Polycarboxylates—Alkoxylated polycarboxylates such as those prepared from polyacrylates are useful herein to provide additional grease removal performance. Such materials are described in WO 91/08281 and PCT 90/01815 at p. 4 et seq., incorporated herein by reference. Chemically, these materials comprise polyacrylates having one ethoxy side-chain per every 7–8 acrylate units. The side-chains are of the formula $—(CH_2CH_2O)_m(CH_2)_nCH_3$ wherein m is 2–3 and n is 6–12. The side-chains are ester-linked to the polyacrylate "backbone" to provide a "comb" polymer type structure. The molecular weight can vary, but is typically in the range of about 2000 to about 50,000. Such alkoxylated polycarboxylates can comprise from about 0.05% to about 10%, by weight, of the compositions herein.

Fabric Softeners—Various through-the-wash fabric softeners, especially the impalpable smectite clays of U.S. Pat. No. 4,062,647, Storm and Nirschl, issued Dec. 13, 1977, as well as other softener clays known in the art, can optionally be used typically at levels of from about 0.5% to about 10% by weight in the present compositions to provide fabric softener benefits concurrently with fabric cleaning. Clay softeners can be used in combination with amine and cationic softeners as disclosed, for example, in U.S. Pat. No. 4,375,416, Crisp et al, Mar. 1, 1983 and U.S. Pat. No. 4,291,071, Harris et al, issued Sep. 22, 1981. Moreover, in laundry cleaning methods herein, known fabric softeners, including biodegradable types, can be used in pretreat, mainwash, post-wash and dryer-added modes.

Perfumes—Perfumes and perfumery ingredients useful in the present compositions and processes comprise a wide variety of natural and synthetic chemical ingredients, including, but not limited to, aldehydes, ketones, esters, and the like. Also included are various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes typically comprise from about 0.01% to about 2%, by weight, of the detergent compositions herein, and individual perfumery ingredients can comprise from about 0.0001% to about 90% of a finished perfume composition.

Non-limiting examples of perfume ingredients useful herein include: 7-acetyl-1,2,3,4,5,6,7,8-octahydro-1,1,6,7-tetramethyl naphthalene; ionone methyl; ionone gamma methyl; methyl cedrylone; methyl dihydrojasmonate; methyl 1,6,10-trimethyl-2,5,9-cyclododecatrien-1-yl ketone; 7-acetyl-1,1,3,4,4,6-hexamethyl tetralin; 4-acetyl-6-tert-butyl-1,1-dimethyl indane; para-hydroxy-phenyl-butanone; benzophenone; methyl beta-naphthyl ketone; 6-acetyl-1,1,2,3,3,5-hexamethyl indane; 5-acetyl-3-isopropyl-1,1,2,6-tetramethyl indane; 1-dodecanal, 4-(4-hydroxy-4-methylpentyl)-3-cyclohexene-1-carboxaldehyde; 7-hydroxy-3,7-dimethyl octanal; 10-undecen-1-al; iso-hexenyl cyclohexyl carboxaldehyde; formyl tricyclodecane; condensation products of hydroxycitronellal and methyl anthranilate, condensation products of hydroxycitronellal and indol, condensation products of phenyl acetaldehyde and indol; 2-methyl-3-(para-tert-butylphenyl)-propionaldehyde; ethyl vanillin; heliotropin; hexyl cinnamic aldehyde; amyl cinnamic aldehyde; 2-methyl-2-(para-iso-propylphenyl)-propionaldehyde; coumarin; decalactone gamma; cyclopentadecanolide; 16-hydroxy-9-hexadecenoic acid lactone; 1,3,4,6,7,8-hexahydro-4,6,6,7,8,8-hexamethylcyclopenta-gamma-2-benzopyrane; beta-naphthol methyl ether; ambroxane; dodecahydro-3a,6,6,9a-tetramethylnaphtho[2,1b]furan; cedrol, 5-(2,2,3-trimethylcyclopent-3-enyl)-3-methylpentan-2-ol; 2-ethyl-4-(2,2,3-trimethyl-3-cyclopenten-1-yl)-2-buten-1-ol; caryophyllene alcohol; tricyclodecenyl propionate; tricyclodecenyl acetate; benzyl salicylate; cedryl acetate; and para-(tert-butyl) cyclohexyl acetate.

Particularly preferred perfume materials are those that provide the largest odor improvements in finished product compositions containing cellulases. These perfumes include but are not limited to: hexyl cinnamic aldehyde; 2-methyl-3-(para-tert-butylphenyl)-propionaldehyde; 7-acetyl-1 ,2,3,4,5,6,7,8-octahydro-1,1,6,7-tetramethyl naphthalene; benzyl salicylate; 7-acetyl-1,1,3,4,4,6-hexamethyl tetralin; para-tert-butyl cyclohexyl acetate; methyl dihydro jasmonate; beta-napthol methyl ether; methyl beta-naphthyl ketone; 2-methyl-2-(para-iso-propylphenyl)-propionaldehyde; 1,3,4,6,7,8-hexahydro-4,6,6,7,8,8-hexamethyl-cyclopenta-gamma-2-benzopyrane; dodecahydro-3a,6,6,9a-tetramethylnaphtho[2,1b]furan; anisaldehyde; coumarin; cedrol; vanillin; cyclopentadecanolide; tricyclodecenyl acetate; and tricyclodecenyl propionate.

Other perfume materials include essential oils, resinoids, and resins from a variety of sources including, but not limited to: Peru balsam, Olibanum resinoid, styrax, labdanum resin, nutmeg, cassia oil, benzoin resin, coriander and lavandin. Still other perfume chemicals include phenyl ethyl alcohol, terpineol, linalool, linalyl acetate, geraniol, nerol, 2-(1,1-dimethylethyl)-cyclohexanol acetate, benzyl acetate, and eugenol. Carriers such as diethylphthalate can be used in the finished perfume compositions.

Other Ingredients—A wide variety of other ingredients useful in detergent compositions can be included in the compositions herein, including other active ingredients, carriers, hydrotropes, processing aids, dyes or pigments, solvents for liquid formulations, solid fillers for bar compositions, etc. If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, water-soluble magnesium and/or calcium salts such as $MgCl_2$, $MgSO_4$, $CaCl_2$, $CaSO_4$ and the like, can be added at levels of, typically, 0.1%–2%, to provide additional suds and to enhance grease removal performance, especially for liquid dishwashing purposes.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used. The compositions may contain from 5% to 90%, typically 10% to 50% of such carriers.

The detergent compositions herein will preferably be formulated such that, during use in aqueous cleaning operations, the wash water will have a pH of between about 6.5 and about 11, preferably between about 7.0 and 10.5, more preferably between about 7.0 to about 9.5. Liquid dishwashing product formulations preferably have a pH between about 6.8 and about 9.0. Laundry products are typically at pH 9–11. Techniques for controlling pH at recommended usage levels include the use of buffers, alkalis, acids, etc., and are well known to those skilled in the art.

Form of the Compositions

The compositions in accordance with the invention can take a variety of physical forms including granular, gel, tablet, bar and liquid forms. The compositions include the so-called concentrated granular detergent compositions adapted to be added to a washing machine by means of a dispensing device placed in the machine drum with the soiled fabric load.

The mean particle size of the components of granular compositions in accordance with the invention should preferably be such that no more that 5% of particles are greater than 1.7 mm in diameter and not more than 5% of particles are less than 0.15 mm in diameter.

The term mean particle size as defined herein is calculated by sieving a sample of the composition into a number of fractions (typically 5 fractions) on a series of Tyler sieves.

The weight fractions thereby obtained are plotted against the aperture size of the sieves. The mean particle size is taken to be the aperture size through which 50% by weight of the sample would pass.

Certain preferred granular detergent compositions in accordance with the present invention are the high-density types, now common in the marketplace; these typically have a bulk density of at least 600 g/litre, more preferably from 650 g/litre to 1200 g/litre.

Surfactant Agglomerate Particles

One of the preferred methods of delivering surfactant in consumer products is to make surfactant agglomerate particles, which may take the form of flakes, prills, marumes, noodles, ribbons, but preferably take the form of granules. A preferred way to process the particles is by agglomerating powders (e.g. aluminosilicate, carbonate) with high active surfactant pastes and to control the particle size of the resultant agglomerates within specified limits. Such a process involves mixing an effective amount of powder with a high active surfactant paste in one or more agglomerators such as a pan agglomerator, a Z-blade mixer or more preferably an in-line mixer such as those manufactured by Schugi (Holland) BV, 29 Chroomstraat 8211 AS, Lelystad, Netherlands, and Gebruder Lodige Maschinenbau GmbH, D-4790 Paderbom 1, Elsenerstrasse 7–9, Postfach 2050, Germany. Most preferably a high shear mixer is used, such as a Lodige CB (Trade Name).

A high active surfactant paste comprising from 50% by weight to 95% by weight, preferably 70% by weight to 85% by weight of surfactant is typically used. The paste may be pumped into the agglomerator at a temperature high enough to maintain a pumpable viscosity, but low enough to avoid degradation of the anionic surfactants used. An operating temperature of the paste of 50° C. to 80° C. is typical.

Laundry Washing Method

Machine laundry methods herein typically comprise treating soiled laundry with an aqueous wash solution in a washing machine having dissolved or dispensed therein an effective amount of a machine laundry detergent composition in accord with the invention. By an effective amount of the detergent composition it is here meant from 40 g to 300 g of product dissolved or dispersed in a wash solution of volume from 5 to 65 liters, as are typical product dosages and wash solution volumes commonly employed in conventional machine laundry methods.

As noted, surfactants are used herein in detergent compositions, preferably in combination with other detersive surfactants, at levels which are effective for achieving at least a directional improvement in cleaning performance. In the context of a fabric laundry composition, such "usage levels" can vary widely, depending not only on the type and severity of the soils and stains, but also on the wash water temperature, the volume of wash water and the type of washing machine.

In a preferred use aspect a dispensing device is employed in the washing method. The dispensing device is charged with the detergent product, and is used to introduce the product directly into the drum of the washing machine before the commencement of the wash cycle. Its volume capacity should be such as to be able to contain sufficient detergent product as would normally be used in the washing method.

Once the washing machine has been loaded with laundry the dispensing device containing the detergent product is placed inside the drum. At the commencement of the wash cycle of the washing machine water is introduced into the drum and the drum periodically rotates. The design of the dispensing device should be such that it permits containment of the dry detergent product but then allows release of this product during the wash cycle in response to its agitation as the drum rotates and also as a result of its contact with the wash water.

Alternatively, the dispensing device may be a flexible container, such as a bag or pouch. The bag may be of fibrous construction coated with a water impermeable protective material so as to retain the contents, such as is disclosed in European published Patent Application No. 0018678. Alternatively it may be formed of a water-insoluble synthetic polymeric material provided with an edge seal or closure designed to rupture in aqueous media as disclosed in European published Patent Application Nos. 0011500, 0011501, 0011502, and 0011968. A convenient form of water frangible closure comprises a water soluble adhesive disposed along and sealing one edge of a pouch formed of a water impermeable polymeric film such as polyethylene or polypropylene.

EXAMPLES

In the following Examples, the abbreviations for the various ingredients used for the compositions have the following meanings.

| | |
|---|---|
| MLAS | Sodium salt of an alkyl benzene sulfonate surfactant system prepared according to any of Examples 1–5 herein. |
| LAS | Sodium linear alkyl benzene sulfonate |
| $MBAS_X$ | Mid-chain branched primary alkyl (average total carbons = x) sulfate |
| $MBAE_XS_Z$ | Mid-chain branched primary alkyl (average total carbons = z) ethoxylate (average EO = x) sulfate, sodium salt |
| $MBAE_X$ | Mid-chain branched primary alkyl (average total carbons = x) ethoxylate (average EO = 8) |
| C18 1,4 disulfate | 2-octadecyl butane 1,4-disulfate |
| Endolase | Endoglunase enzyme of activity 3000 CEVU/g sold by NOVO Industries A/S |
| MEA | Monoethanolamine |
| PG | Propanediol |
| EtOH | Ethanol |
| NaOH | Solution of sodium hydroxide |
| NaTS | Sodium toluene sulfonate |
| Citric acid | Anhydrous citric acid |
| CxyFA | $C_{1x}$–$C_{1y}$ fatty acid |
| CxyEz | A $C_{1x-1y}$ branched primary alcohol condensed with an average of z moles of ethylene oxide |
| Carbonate | Anhydrous sodium carbonate with a particle size between 200 $\mu$m and 900 $\mu$m |
| Citrate | Tri-sodium citrate dihydrate of activity 86.4% with a particle size distribution between 425 $\mu$m and 850 $\mu$m |
| TFAA | C16–18 alkyl N-methyl glucamide |
| LMFAA | C12–14 alkyl N-methyl glucamide |
| APA | C8–C10 amido propyl dimethyl amine |
| Fatty Acid (C12/14) | C12–C14 fatty acid |
| Fatty Acid (TPK) | Topped palm kernel fatty acid |
| Fatty Acid (RPS) | Rapeseed fatty acid |
| Borax | Na tetraborate decahydrate |
| PAA | Polyacrylic Acid (mw = 4500) |
| PEG | Polyethylene glycol (mw = 4600) |
| MES | Alkyl methyl ester sulfonate |
| SAS | Secondary alkyl sulfate |
| NaPS | Sodium paraffin sulfonate |
| CxyAS | Sodium $C_{1x}$–$C_{1y}$ alkyl sulfate (or other salt if specified) |
| CxyEzS | Sodium $C_{1x}$–$C_{1y}$ alkyl sulfate condensed with z moles of ethylene oxide (or other salt if specified) |
| CxyEz | A $C_{1x-1y}$ branched primary alcohol condensed with an average of z moles of ethylene oxide |

-continued

| | |
|---|---|
| QAS | $R_2.N^+(CH_3)_x((C_2H_4O)yH)z$ with $R_2 = C_8–C_{18}$ $x + z = 3$, $x = 0$ to 3, $z = 0$ to 3, $y = 1$ to 15. |
| STPP | Anhydrous sodium tripolyphosphate |
| Zeolite A | Hydrated Sodium Aluminosilicate of formula $Na_{12}(A10_2SiO_2)_{12}.27H_2O$ having a primary particle size in the range from 0.1 to 10 micrometers |
| NaSKS-6 | Crystalline layered silicate of formula $\delta$-$Na_2Si_2O_5$ |
| Bicarbonate | Anhydrous sodium bicarbonate with a particle size distribution between 400 $\mu$m and 1200 $\mu$m |
| Silicate | Amorphous Sodium Silicate ($SiO_2$:$Na_2O$; 2.0 ratio) |
| Sulfate | Anhydrous sodium sulfate |
| PAE | ethoxylated tetraethylene pentamine |
| PIE | ethoxylated polyethylene imine |
| PAEC | methyl quaternized ethoxylated dihexylene triamine |
| MA/AA | Copolymer of 1:4 maleic/acrylic acid, average molecular weight about 70,000. |
| CMC | Sodium carboxymethyl cellulose |
| Protease | Proteolytic enzyme of activity 4 KNPU/g sold by NOVO Industries A/S under the tradename Savinase |
| Cellulase | Cellulytic enzyme of activity 1000 CEVU/g sold by NOVO Industries A/S under the tradename Carezyme |
| Amylase | Amylolytic enzyme of activity 60 KNU/g sold by NOVO Industries A/S under the tradename Termamyl 60 T |
| Lipase | Lipolytic enzyme of activity 100 kLU/g sold by NOVO Industries A/S under the tradename Lipolase |
| PB1 | Sodium perborate monohydrate bleach |
| PB4 | Sodium perborate tetrahydrate bleach |
| Percarbonate | Sodium Percarbonate of nominal formula $2Na_2CO_3.3H_2O_2$ |
| NaDCC | Sodium dichloroisocyanurate |
| NOBS | Nonanoyloxybenzene sulfonate, sodium salt |
| TAED | Tetraacetylethylenediamine |
| DTPMP | Diethylene triamine penta (methylene phosphonate), marketed by Monsanto as Dequest 2060 |
| Photobleach | Sulfonated Zinc Phthalocyanine bleach encapsulated in dextrin soluble polymer |
| Brightener 1 | Disodium 4,4'-bis(2-sulphostyryl)biphenyl |
| Brightener 2 | Disodium 4,4'-bis(4-anilino-6-morpholino-1.3.5-triazin-2-yl)amino) stilbene-2:2'-disulfonate. |
| HEDP | 1,1-hydroxyethane diphosphonic acid |
| SRP 1 | Sulfobenzoyl end capped esters with oxyethylene oxy and terephthaloyl backbone |
| SRP 2 | sulfonated ethoxylated terephthalate polymer |
| SRP 3 | methyl capped ethoxylated terephthalate polymer |
| Silicone antifoam | Polydimethylsiloxane foam controller with siloxane-oxyalkylene copolymer as dispersing agent with a ratio of said foam controller to said dispersing agent of 10:1 to 100:1. |
| Isofol 16 | Condea trademark for C16 (average) Guerbet alcohols |
| CaC12 | Calcium chloride |
| MgC12 | Magnesium chloride |
| Diamine | alkyl diamine, e.g., 1,3 propanediamine, Dytek EP, Dytek A, where Dytek is a Dupont tradename, 2-hydroxy propane diamine |
| DTPA | Diethylene triamine pentaacetic acid |
| Dimethicone | 40 (gum)/60 (fluid) weight ratio blend of SE-76 dimethicone gum from General Electric Silicones Division, and a dimethicone fluid having a viscosity of 350 centistokes. |
| Minors | Low level materials such as dyes, perfumes, or colorants, and/or filler materials (e.g., talc, NaCl, sulfates). |

Unless otherwise noted, ingredients are anhydrous.

In the following Examples all levels are quoted as % by weight of the composition. The following examples are illustrative of the present invention, but are not meant to limit or otherwise define its scope. All parts, percentages and ratios used herein are expressed as percent weight unless otherwise specified.

EXAMPLE 6

The following laundry detergent compositions A to D suitable for hand-washing soiled fabrics are prepared in accord with the invention:

| | A | B | C | D |
|---|---|---|---|---|
| MLAS | 18 | 22 | 18 | 22 |
| STPP | 20 | 40 | 22 | 28 |
| Carbonate | 15 | 8 | 20 | 15 |
| Silicates | 15 | 10 | 15 | 10 |
| Protease | 0 | 0 | 0.3 | 0.3 |
| Perborate | 0 | 0 | 0 | 10 |
| Sodium Chloride | 25 | 15 | 20 | 10 |
| Brightener | 0–0.3 | 0.2 | 0.2 | 0.2 |
| Moisture & Minors | | | Balance | |

EXAMPLE 7

The following laundry detergent compositions E to H suitable for hand-washing soiled fabrics are prepared in accord with the invention:

| | E | F | G | H |
|---|---|---|---|---|
| MLAS | 22 | 16 | 11 | 1–6 |
| Any Combination of: C45 AS C4SE1S C45E3S LAS MBAS16.5 MBAE2S15.5 | 0 | 0–5 | 5–15 | 10–20 |
| QAS | 0–5 | 0–1 | 0–5 | 0–3 |
| Any Combination of: C23E6.5 C45E7 | 0–2 | 0–4 | 0–2 | 0–2 |
| STPP | 5–45 | 5–45 | 5–45 | 5–45 |
| PAA | 0–2 | 0–2 | 0–2 | 0–2 |
| CMC | 0–0.5 | 0–0.5 | 0–0.5 | 0–0.5 |
| Protease | 0–0.5 | 0–0.5 | 0–0.5 | 0–0.5 |
| Cellulase | 0–0.3 | 0–0.3 | 0–0.3 | 0–0.3 |
| Amylase | 0–0.5 | 0–0.5 | 0–0.5 | 0–0.5 |
| SRP 1, 2 or 3 | 0–0.5 | 0.4 | 0–0.5 | 0–0.5 |
| Brightener 1 or 2, perfume | 0–0.3 | 0–0.2 | 0–0.3 | 0–0.2 |
| Photobleach | 0–0.1 | 0–0.1 | 0–0.1 | 0–0.1 |
| Carbonate | 15 | 10 | 20 | 15 |
| Silicate | 7 | 15 | 10 | 8 |
| Sulfate | 5 | 5 | 5 | 5 |
| Moisture & Minors | | | Balance | |

EXAMPLE 8

The following laundry detergent compositions I to L suitable for hand-washing soiled fabrics are prepared in accord with the invention:

| | I | J | K | L |
|---|---|---|---|---|
| MLAS | 18 | 25 | 15 | 18 |
| QAS | 0.6 | 0–1 | 0.5 | 0.6 |
| Any Combination of: C23E6.5 C45E7 | 1.2 | 1.5 | 1.2 | 1.0 |
| C25E3S | 1.0 | 0 | 1.5 | 0 |
| STPP | 25 | 40 | 22 | 25 |
| Bleach Activator (NOBS or TAED) | 1.9 | 1.2 | 0.7 | 0–0.8 |
| PB1 | 2.3 | 2.4 | 1.5 | 0.7–1.7 |

-continued

| | I | J | K | L |
|---|---|---|---|---|
| DTPA or DTPMP | 0.9 | 0.5 | 0.5 | 0.3 |
| PAA | 1.0 | 0.8 | 0.5 | 0 |
| CMC | 0.5 | 1.0 | 0.4 | 0 |
| Protease | 0.3 | 0.5 | 0.7 | 0.5 |
| Cellulase | 0.1 | 0.1 | 0.05 | 0.08 |
| Amylase | 0.5 | 0 | 0.7 | 0 |
| SRP 1, 2 or 3 | 0.2 | 0.2 | 0.2 | 0 |
| Polymeric dispersant | 0 | 0.5 | 0.4 | 0 |
| Brightener 1 or 2 | 0.3 | 0.2 | 0.2 | 0.2 |
| Photobleach | 0.005 | 0.005 | 0.002 | 0 |
| Carbonate | 13 | 15 | 5 | 10 |
| Silicate | 7 | 5 | 6 | 7 |
| Moisture & Minors | Balance | | | |

EXAMPLE 9

The following laundry detergent compositions A to E are prepared in accord with the invention:

| | A | B | C | D | E |
|---|---|---|---|---|---|
| MLAS | 22 | 16.5 | 11 | 1–5.5 | 10–25 |
| Any Combination of: C45 AS C45E1S LAS C16 SAS C14–17 NaPS C14–18 MES MBAS16.5 MBAE2S15.5 | 0 | 1–5.5 | 11 | 16.5 | 0–5 |
| QAS | 0–2 | 0–2 | 0–2 | 0–2 | 0–4 |
| C23E6.5 or C45E7 | 1.5 | 1.5 | 1.5 | 1.5 | 0–4 |
| Zeolite A | 27.8 | 27.8 | 27.8 | 27.8 | 20–30 |
| PAA | 2.3 | 2.3 | 2.3 | 2.3 | 0–5 |
| Carbonate | 27.3 | 27.3 | 27.3 | 27.3 | 20–30 |
| Silicate | 0.6 | 0.6 | 0.6 | 0.6 | 0–2 |
| PB1 | 1.0 | 1.0 | 1.0 | 1.0 | 0–3 |
| Protease | 0–0.5 | 0–0.5 | 0–0.5 | 0–0.5 | 0–0.5 |
| Cellulase | 0–0.3 | 0–0.3 | 0–0.3 | 0–0.3 | 0–0.5 |
| Amylase | 0–0.5 | 0–0.5 | 0–0.5 | 0–0.5 | 0–1 |
| SRP 1 | 0.4 | 0.4 | 0.4 | 0.4 | 0–1 |
| Brightener 1 or 2 | 0.2 | 0.2 | 0.2 | 0.2 | 0–0.3 |
| PEG | 1.6 | 1.6 | 1.6 | 1.6 | 0–2 |
| Sulfate | 5.5 | 5.5 | 5.5 | 5.5 | 0–6 |
| Silicone Antifoam | 0.42 | 0.42 | 0.42 | 0.42 | 0–0.5 |
| Moisture & Minors | Balance | | | | |

EXAMPLE 10

The following laundry detergent compositions F to K are prepared in accord with the invention:

| | F | G | H | I | J | K |
|---|---|---|---|---|---|---|
| MLAS | 32 | 24 | 16 | 8 | 4 | 1–35 |
| Any Combination of: C45 AS C45E1S LAS C16 SAS C14–17 NaPS C14–18 MES MBAS16.5 MBAE1.5S15.5 | 0 | 8 | 16 | 24 | 28 | 0–35 |
| C23E6.5 or C45E7 | 3.6 | 3.6 | 3.6 | 3.6 | 3.6 | 0–6 |
| QAS | 0–1 | 0–1 | 0–1 | 0–1 | 0–1 | 0–4 |
| Zeolite A | 9.0 | 9.0 | 9.0 | 9.0 | 9.0 | 0–20 |

-continued

| | F | G | H | I | J | K |
|---|---|---|---|---|---|---|
| PAA or MA/AA | 7.0 | 7.0 | 7.0 | 7.0 | 7.0 | 0–10 |
| Carbonate | 18.4 | 18.4 | 18.4 | 18.4 | 18.4 | 5–25 |
| Silicate | 11.3 | 11.3 | 11.3 | 11.3 | 11.3 | 5–25 |
| PB1 | 3.9 | 3.9 | 3.9 | 3.9 | 3.9 | 1–6 |
| NOBS | 4.1 | 4.1 | 4.1 | 4.1 | 4.1 | 0–6 |
| Protease | 0.9 | 0.9 | 0.9 | 0.9 | 0.9 | 0–1.3 |
| Amylase | 0–0.5 | 0–0.5 | 0–0.5 | 0–0.5 | 0–0.5 | 0–0.5 |
| Cellulase | 0–0.3 | 0–0.3 | 0–0.3 | 0–0.3 | 0–0.3 | 0–0.3 |
| SRP1 | 0.5 | 0.5 | 0.5 | 0.5 | 0.5 | 0–1 |
| Brightener 1 or 2 | 0.3 | 0.3 | 0.3 | 0.3 | 0.3 | 0–0.5 |
| PEG | 0.2 | 0.2 | 0.2 | 0.2 | 0.2 | 0–0.5 |
| Sulfate | 5.1 | 5.1 | 5.1 | 5.1 | 5.1 | 0–10 |
| Silicone Antifoam | 0.2 | 0.2 | 0.2 | 0.2 | 0.2 | 0–0.5 |
| Moisture & Minors | Balance | | | | | |

EXAMPLE 11

The following liquid laundry detergent compositions L to P are prepared in accord with the invention:

| | L | M | N | O | P |
|---|---|---|---|---|---|
| MLAS | 1–7 | 7–12 | 12–17 | 17–22 | 1–35 |
| Any combination of: C25 AExS*Na (x = 1.8–2.5) MBAE1.8S15.5 MBAS15.5 C25 AS (linear to high 2-alkyl) C14–17 NaPS C12–16 SAS C18 1,4 disulfate LAS C12–16 MES | 15–21 | 10–15 | 5–10 | 0–5 | 0–25 |
| LMFAA | 0–3.5 | 0–3.5 | 0–3.5 | 0–3.5 | 0–8 |
| C23E9 or C23E6.5 | 0–2 | 0–2 | 0–2 | 0–2 | 0–8 |
| APA | 0–0.5 | 0–0.5 | 0–0.5 | 0–0.5 | 0–2 |
| Citric Acid | 5 | 5 | 5 | 5 | 0–8 |
| Fatty Acid (TPK or C12/14) | 2–7.5 | 2–7.5 | 2–7.5 | 2–7.5 | 0–14 |
| Fatty Acid (RPS) | 0–3.1 | 0–3.1 | 0–3.1 | 0–3.1 | 0–3.1 |
| EtOH | 4 | 4 | 4 | 4 | 0–8 |
| PG | 6 | 6 | 6 | 6 | 0–10 |
| MEA | 1 | 1 | 1 | 1 | 0–3 |
| NaOH | 3 | 3 | 3 | 3 | 0–7 |
| Na TS | 2.3 | 2.3 | 2.3 | 2.3 | 0–4 |
| Na formate | 0.1 | 0.1 | 0.1 | 0.1 | 0–1 |
| Borax | 2.5 | 2.5 | 2.5 | 2.5 | 0–5 |
| Protease | 0.9 | 0.9 | 0.9 | 0.9 | 0–1.3 |
| Lipase | 0.06 | 0.06 | 0.06 | 0.06 | 0–0.3 |
| Amylase | 0.15 | 0.15 | 0.15 | 0.15 | 0–0.4 |
| Cellulase | 0.05 | 0.05 | 0.05 | 0.05 | 0–0.2 |
| PAE | 0–0.6 | 0–0.6 | 0–0.6 | 0–0.6 | 0–2.5 |
| PIE | 1.2 | 1.2 | 1.2 | 1.2 | 0–2.5 |
| PAEC | 0–0.4 | 0–0.4 | 0–0.4 | 0–0.4 | 0–2 |
| SRP 2 | 0.2 | 0.2 | 0.2 | 0.2 | 0–0.5 |
| Brightener 1 or 2 | 0.15 | 0.15 | 0.15 | 0.15 | 0–0.5 |
| Silicone antifoam | 0.12 | 0.12 | 0.12 | 0.12 | 0–0.3 |
| Fumed Silica | 0.0015 | 0.0015 | 0.0015 | 0.0015 | 0–0.003 |
| Perfume | 0.3 | 0.3 | 0.3 | 0.3 | 0–0.6 |
| Dye | 0.0013 | 0.0013 | 0.0013 | 0.0013 | 0–0.003 |
| Moisture/minors | Balance | Balance | Balance | Balance | Balance |
| Product pH (10% in DI water) | 7.7 | 7.7 | 7.7 | 7.7 | 6–9.5 |

EXAMPLE 12

A non-limiting example of bleach-containing nonaqueous liquid laundry detergent is prepared having the composition as follows:

| Component | Q Wt. % | R Range (% wt.) |
|---|---|---|
| Liquid Phase | | |
| MLAS | 15 | 1–35 |
| LAS | 12 | 0–35 |
| C24E5 | 14 | 10–20 |
| Hexylene glycol | 27 | 20–30 |
| Perfume | 0.4 | 0–1 |
| Solids | | |
| Protease | 0.4 | 0–1 |
| $Na_3$ Citrate, anhydrous | 4 | 3–6 |
| PB1 | 3.5 | 2–7 |
| NOBS | 8 | 2–12 |
| Carbonate | 14 | 5–20 |
| DTPA | 1 | 0–1.5 |
| Brightener 1 or 2 | 0.4 | 0–0.6 |
| Suds Suppressor | 0.1 | 0–0.3 |
| Minors | Balance | Balance |

The resulting composition is a stable anhydrous heavy duty liquid laundry detergent which provides excellent stain and soil removal performance when used in normal fabric laundering operations.

EXAMPLE 13

The following examples further illustrates the invention herein with respect to a hand dishwashing liquid.

| Ingredient | S % (wt.) | T Range (% wt.) |
|---|---|---|
| MLAS | 15 | 0.1–25 |
| Ammonium C23AS | 5 | 0–35 |
| C24E1S | 5 | 0–35 |
| LMFAA | 3 | 0–10 |
| Coconut amine oxide | 2.6 | 1–5 |
| Betaine/Tetronic 704 ®** | 0.87/0.10 | 0–2/0–0.5 |
| C9,11E9 | 5 | 2–10 |
| $NH_3$ xylene sulfonate | 4 | 1–6 |
| EtOH | 4 | 0–7 |
| Ammonium citrate | 0.1 | 0–1 |
| MgCl2 | 3.3 | 0–4 |
| CaCl2 | 2.5 | 0–4 |
| Diamine | 2 | 0–8 |
| Animonium sulfate | 0.08 | 0–4 |
| Hydrogen peroxide | 200 ppm | 10–300 ppm |
| Perfume | 0.18 | 0–0.5 |
| Maxatase ® protease | 0.50 | 0–1.0 |
| Water and minors | Balance | Balance |

**Cocoalkyl betaine.

EXAMPLE 14

The following examples further illustrate the invention herein with respect to shampoo formulations.

| Component | NN | OO | PP | QQ | RR |
|---|---|---|---|---|---|
| Ammonium C24E2S | 5 | 3 | 2 | 10 | 8 |
| Ammonium C24AS | 5 | 5 | 4 | 5 | 8 |
| MLAS | 0.6 | 1 | 4 | 5 | 7 |
| Cocamide MEA | 0 | 0.68 | 0.68 | 0.8 | 0 |
| PEG 14,000 mol. wt. | 0.1 | 0.35 | 0.5 | 0.1 | 0 |
| Cocoamidopropylbetaine | 2.5 | 2.5 | 0 | 0 | 1.5 |
| Cetylalcohol | 0.42 | 0.42 | 0.42 | 0.5 | 0.5 |

-continued

| Component | NN | OO | PP | QQ | RR |
|---|---|---|---|---|---|
| Stearylalcohol | 0.18 | 0.18 | 0.18 | 0.2 | 0.18 |
| Ethylene glycol distearate | 1.5 | 1.5 | 1.5 | 1.5 | 1.5 |
| Dimethicone | 1.75 | 1.75 | 1.75 | 1.75 | 2.0 |
| Perfume | 0.45 | 0.45 | 0.45 | 0.45 | 0.45 |
| Water and minors | balance | balance | balance | balance | balance |

What is claimed is:

1. A composition suitable as a source for making alkylarylsulfonate surfactants, wherein said composition comprises at least two isomers of the formula:

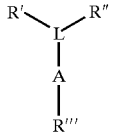

wherein:

L is an acyclic aliphatic hydrocarbyl of from 6 to 18 carbon atoms in total;

R' is selected from H and $C_1$ to $C_3$ alkyl;

R" is selected from H and $C_1$ to $C_3$ alkyl;

both R' and R" are nonterminally attached to L and at least one of R' and R" is $C_1$ to $C_3$ alkyl;

R''' is selected from H and $C_1$ to $C_3$ alkyl; and

A is an aromatic hydrocarbon selected from the group consisting of benzene, toluene, xylene, naphthalene, and mixtures thereof;

wherein:

said alkylaryl composition comprises two or more isomers with respect to positions of attachment of R', R" and A to L;

in at least about 60% of said alkylaryl composition, A is attached to L in the position which is selected from positions alpha- and beta- to either of the two terminal carbon atoms thereof; and wherein further said alkylaryl composition has a ratio of nonquaternary to quaternary carbon atoms in L of at least about 10:1 by weight, when said quaternary carbon atoms are present.

2. The composition according to claim 1 wherein A is benzene.

3. The composition according to claim 1 wherein A is toluene.

4. The composition according to claim 1 wherein one of R' and R" is methyl or ethyl.

5. The composition according to claim 1 wherein one of R' and R" is methyl.

6. A composition suitable as a source for making alkylarylsulfonate surfactants, wherein said composition comprises at least two isomers, counted exclusive of ortho-, meta-, para-, and stereoisomers, of the formula:

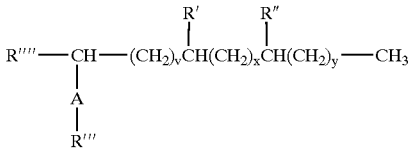

wherein A is an aromatic hydrocarbon selected from the group consisting of benzene, toluene, xylene, naphthalene, and mixtures thereof; R''' is selected from H and $C_1$ to $C_3$ alkyl; R' is selected from hydrogen and $C_1$ to $C_3$ alkyl; R'' is selected from hydrogen and $C_1$ to $C_3$ alkyl; and R'''' is selected from hydrogen and $C_1$ to $C_4$ alkyl; v is an integer from 0 to 10; x is an integer from 0 to 10; y is an integer from 0 to 10;

wherein:

the total number of carbon atoms attached to A is less than about 20;

said composition comprises two or more isomers with respect to positions of attachment of R', R'' and A to the moiety R''''—C(—)H$(CH_2)_v$C(—)H$(CH_2)_x$C(—)H$(CH_2)_y$—$CH_3$ of this formula;

at least one of R' and R'' is $C_1$ to $C_3$ alkyl; when R'''' is $C_1$, the sum of v+x+y is at least 1; and when R'''' is H, the sum of v+x+y is at least 2; and in at least about 60% of said alkylaryl composition, A is attached to the moiety R''''—C(—)H$(CH_2)_v$C(—)H$(CH_2)_x$C(—)H$(CH_2)_y$—$CH_3$ in the position which is selected from positions alpha- and beta- to either of the two terminal carbon atoms thereof;

wherein further said composition has a ratio of nonquaternary to quaternary carbon atoms in the moiety R''''—C(—)H$(CH_2)_v$C(—)H$(CH_2)_x$C(—)H$(CH_2)_y$—$CH_3$ of at least about 10:1 by weight, when said quaternary carbon atoms are present.

7. The composition according to claim 6 wherein A is benzene.

8. The composition according to claim 6 wherein A is totuene.

9. The composition according to claim 6 wherein one of R' and R'' is methyl or ethyl.

10. The composition according to claim 6 wherein one of R' and R'' is methyl.

11. The composition according to claim 6 wherein at least about 80% of said composition, A is attached to R''''—CH$(CH_2)_v$CH$(CH_2)_x$CH$(CH_2)_y$—$CH_3$ in the position which is selected from positions alpha- and beta- to either of the two terminal carbon atoms thereof.

12. The composition according to claim 6 wherein R'''' is hydrogen, methyl or ethyl.

13. A composition suitable as a source for making alkylazylsulfonate surfactants, wherein said composition comprises:

a) from about 0.01% to about 99.99% by weight of an composition comprising at least two isomers of the formula:

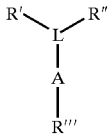

wherein:

L is an acyclic aliphatic hydrocarbyl of from 6 to 18 carbon atoms in total;

R' is selected from H and $C_1$ to $C_3$ alkyl;

both R' and R'' are nonterminally attached to L and at least one of R' and R'' is $C_1$ to $C_3$ alkyl;

R''' is selected from H and $C_1$ to $C_3$ alkyl; and

A is an aromatic hydrocarbon selected from the group consisting of benzene, toluene, xylene, naphthalene, and mixtures thereof;

wherein:

said composition comprises two or more isomers with respect to positions of attachment of R', R'' and A to L;

in at least about 60% of said composition, A is attached to L in the position which is selected from positions alpha- and beta- to either of the two terminal carbon atoms thereof; and wherein further said composition has a ratio of nonquaternary to quaternary carbon atoms in L of at least about 10:1 by weight, when said quaternary carbon atoms are present; and b) from about 0.01% to about 99.99% by weight of at least one isomer of the linear analog of said composition of (a).

14. The composition according to claim 13 wherein at least about 80% of said composition, A is attached to L in the position which is selected from positions alpha- and beta- to either of the two terminal carbon atoms thereof.

15. The composition according to claim 13 wherein A is benzene.

16. The composition according to claim 13 wherein A is toluene.

17. The composition according to claim 13 wherein one of R' and R'' is methyl or ethyl.

18. The composition according to claim 13 wherein one of R' and R'' is methyl.

19. A composition suitable as a source for making alkylarylsulfonate surfactants, wherein said composition comprises:

a) from about 0.01% to about 99.99% by weight of an composition comprising at least two isomers, counted exclusive of ortho-, meta-, para- and stercoisomers, of an alkylaryl of the formula:

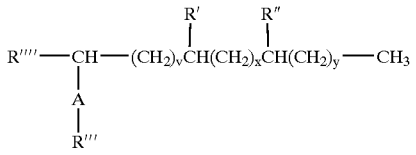

wherein A is an aromatic hydrocarbon selected from the group consisting of benzene, toluene, xylene, naphthalene, and mixtures thereof; R''' is selected from H and $C_1$ to $C_3$ alkyl; R' is selected from hydrogen and $C_1$ to $C_3$ alkyl; R'' is selected from hydrogen and $C_1$ to $C_3$ alkyl; and R'''' is selected from hydrogen and $C_1$ to $C_4$ alkyl; v is an integer from 0 to 10; x is an integer from 0 to 10; y is an integer from 0 to 10;

wherein:

the total number of carbon atoms attached to A is less than about 20;

said composition comprises two or more isomers with respect to positions of attachment of R', R" and A to the moiety $R''''—C(—)H(CH_2)_vC(—)H(CH_2)_xC(—)H(CH_2)_yCH_3$ of this formula;

at least one of R' and R" is $C_1$ to $C_3$ alkyl; when R"" is $C_1$, the sum of v+x+y is at least 1; and when R"" is H, the sum of v+x+y is at least 2; and in at least about 60% of said composition, A is attached to the moiety $R''''—C(—)H(CH_2)_vC(—)H(CH_2)_xC(—)H(CH_2)_y—CH_3$ in the position which is selected from positions alpha- and beta- to either of the two terminal carbon atoms thereof;

wherein further said composition has a ratio of non-quaternary to quaternary carbon atoms in the moiety $R''''—C(—)H(CH_2)_vC(—)H(CH_2)_xC(—)H(CH_2)_y—CH_3$ of at least about 10:1 by weight, when said quaternary carbon atoms are present; and b) from about 0.01% to about 99.99% by weight of at least one isomer of the linear analog of said composition of (a).

20. The composition according to claim 19 wherein A is benzene.

21. The composition according to claim 19 wherein A is toluene.

22. The composition according to claim 19 wherein one of R' and R" is methyl or ethyl.

23. The composition according to claim 19 wherein one of R' and R" is methyl.

24. The composition according to claims 19 wherein at least about 80% of said composition, A is attached to $R''''—CH(CH_2)_vCH(CH_2)_xCH(CH_2)_y—CH_3$ in the position which is selected from positions alpha- and beta- to either of the two terminal carbon atoms thereof.

25. The composition according to claim 19 wherein R"" is hydrogen, methyl or ethyl.

* * * * *

UNITED STATES PATENT AND TRADEMARK OFFICE

CERTIFICATE OF CORRECTION

PATENT NO. : 6,908,894 B2
DATED : June 21, 2005
INVENTOR(S) : Kevin Lee Kott

It is certified that error appears in the above-identified patent and that said Letters Patent is hereby corrected as shown below:

Title page, Item [54] and Column 1, line 1,
Title, should read:
-- ALKYLARYLS --.

Signed and Sealed this

Twenty-third Day of August, 2005

JON W. DUDAS
*Director of the United States Patent and Trademark Office*